US012196475B2

(12) United States Patent
Park et al.

(10) Patent No.: US 12,196,475 B2
(45) Date of Patent: Jan. 14, 2025

(54) REFRIGERATOR

(71) Applicant: LG Electronics Inc., Seoul (KR)

(72) Inventors: Jong Gyu Park, Seoul (KR); Kihwang Kim, Seoul (KR); JungHyuk Cho, Seoul (KR); Sunghee Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 287 days.

(21) Appl. No.: 17/783,912

(22) PCT Filed: Sep. 17, 2020

(86) PCT No.: PCT/KR2020/012586
§ 371 (c)(1),
(2) Date: Jun. 9, 2022

(87) PCT Pub. No.: WO2021/118021
PCT Pub. Date: Jun. 17, 2021

(65) Prior Publication Data

US 2023/0011875 A1 Jan. 12, 2023

(30) Foreign Application Priority Data

Dec. 9, 2019 (KR) ..... 10-2019-0163004

(51) Int. Cl.
*F25D 17/06* (2006.01)
*F25D 17/08* (2006.01)

(52) U.S. Cl.
CPC ..... *F25D 17/065* (2013.01); *F25D 17/08* (2013.01); *F25D 2317/061* (2013.01); *F25D 2317/0671* (2013.01)

(58) Field of Classification Search
CPC ..... F25D 17/065; F25D 2317/0671; F25D 2317/061; F25D 17/08
See application file for complete search history.

(56) References Cited

U.S. PATENT DOCUMENTS

2017/0343269 A1* 11/2017 Kim ..... F25D 23/068

FOREIGN PATENT DOCUMENTS

| | | | | |
|---|---|---|---|---|
| JP | 2003202176 A | * | 7/2003 | ..... F25B 41/046 |
| KR | 199850616 A | * | 9/1998 | |
| KR | 2000040210 A | * | 7/2000 | |
| KR | 100716254 | | 5/2007 | |
| KR | 20070109690 | | 11/2007 | |

(Continued)

OTHER PUBLICATIONS

Translated_Yang (Year: 2018).*

(Continued)

*Primary Examiner* — Elizabeth J Martin
*Assistant Examiner* — Samba Gaye
(74) *Attorney, Agent, or Firm* — Fish & Richardson P.C.

(57) ABSTRACT

A refrigerator includes a cool air flow path for an ice making compartment and a cool air flow path for a freezing compartment. The cool air flow paths are integrally formed on opposed surfaces between a shroud and a grill fan. A freezing fan and an ice making fan are collectively installed at the shroud. The cool air flow path for the ice making compartment and the cool air flow path for the freezing compartment are defined between the grill fan and the shroud by the operation of intimately coupling the shroud to the grill fan.

18 Claims, 26 Drawing Sheets

(56) References Cited

FOREIGN PATENT DOCUMENTS

| | | | | | |
|---|---|---|---|---|---|
| KR | 2011097014 | A | * | 8/2011 | |
| KR | 20170133840 | | | 12/2017 | |
| KR | 2018080652 | A | * | 7/2018 | ..... F25B 21/02 |
| KR | 1918445 | B1 | * | 11/2018 | ..... H01M 10/05 |
| WO | WO-2017211073 | A1 | * | 12/2017 | ..... F25D 17/00 |
| WO | WO-2019001501 | A1 | * | 1/2019 | ..... F25D 11/02 |

OTHER PUBLICATIONS

Translated_Lee (Year: 2011).*
Translated_Chang (Year: 2017).*
Translated_Cheng (Year: 2019).*
Translated_Rak (Year: 2018).*
Translated_Jeong (Year: 2000).*
Translated_Takahiro (Year: 2003).*
Translated_bOK (Year: 1998).*

* cited by examiner

REFRIGERATOR

CROSS-REFERENCE TO RELATED APPLICATIONS

This application is a National Stage application under 35 U.S.C. § 371 of International Application No. PCT/KR2020/012586, filed on Sep. 17, 2020, which claims the benefit of Korean Patent Application No. 10-2019-0163004, filed on Dec. 9, 2019. The disclosures of the prior applications are incorporated by reference in their entirety.

TECHNICAL FIELD

The present disclosure relates to a refrigerator that includes a refrigerator compartment and a freezing compartment providing respective storage spaces, with an ice making compartment provided on a refrigerating compartment door.

BACKGROUND ART

A refrigerator is a home appliance for long-term storage of various foods by cool air generated by means of circulation of a refrigerant according to a refrigeration cycle.

A refrigerator includes at least one storage chamber for storing food and other items therein. For example, the storage chamber may be partitioned into a plurality of storage compartments that are isolated from each other. In this case, the storage chamber may be a storage chamber that is opened and closed by a rotary door, or may be a drawer-type storage chamber that moves in and out of the refrigerator.

In particular, the storage chamber may include a freezing compartment for freezing storage of items and a refrigerating compartment for cold storage of items. For example, the storage chamber may include at least two freezing compartments or at least two refrigerating compartments.

There has been a recent trend toward the use of refrigerators in which an ice making compartment is provided on a refrigerating compartment door so that a user can take out ice without opening a freezing compartment door.

That is, cool air passing through an evaporator in a cabinet is transferred to the refrigerating compartment door along a cool air duct for the ice making compartment, and in a closed state of the refrigerating compartment door, the cool air is supplied to the ice making compartment through a connection flow path provided in the refrigerating compartment door.

Examples of this type of refrigerator are disclosed in Korean Patent Application Publication No. 10-2006-0129664, Korean Patent Application Publication No. 10-2009-0101525, Korean Patent No. 10-1659622, and Korean Patent No. 10-0918445.

However, in the above-mentioned technologies, a grill fan assembly located in a freezing compartment to supply cool air to the freezing compartment and an ice making fan module supplying cool air to an ice making compartment are separately provided and then coupled to each other, which may cause inconvenience to a user.

That is, the ice making fan module includes an additional fan duct for guiding cool air to a cool air duct for the ice making compartment, so there may be caused a case where it is difficult to exactly match the fan duct to the cool air duct for the ice making compartment when installing the ice making fan module in the grill fan assembly. Therefore, an operator's attention is required to match the fan duct to the cool air duct for the ice making compartment.

Furthermore, in a refrigerator in which a refrigerating compartment door includes an ice making compartment as in the above-mentioned technologies, cool air recovered from the ice making compartment is guided to flow into a freezing compartment, there may be caused a temperature difference in which a first portion of the interior of the refrigerator where cool air flows from the ice making compartment has a relatively high temperature compared to a second portion opposite to the first portion. Due to the temperature difference in each portion of the freezing compartment, there may be a problem in that temperature sensing cannot be performed accurately and thus temperature control in the freezing compartment cannot be performed accurately.

In addition, in the above-mentioned technologies, the flow path to the ice making compartment is longer than that to the freezing compartment, so the same type of fan cannot be used as the ice making fan module for supplying cool air to the ice making compartment and the freezing fan module for supplying cool air to the freezing compartment. Therefore, there may be a problem in that commonization and standardization of the fan cannot be achieved.

Moreover, in the above-mentioned technologies, since the flow path to the ice making compartment is longer than that to the freezing compartment, sufficient cool air cannot be supplied to the ice making compartment, and therefore, there may be a problem in that ice in an ice tray provided in the ice making compartment cannot be sufficiently frozen.

DISCLOSURE

Technical Problem

Accordingly, the present disclosure has been made keeping in mind the above problems occurring in the related art, and an objective of the present disclosure is to provide a new type of refrigerator, wherein installation of a grill fan assembly is easy and simple while minimizing components.

Another objective of the present disclosure is to provide a new type of refrigerator, wherein the difference in temperature for each part in a freezing compartment is minimized through the design of a grill fan assembly in consideration of cool air recovered from an ice making compartment to the freezing compartment.

Still another objective of the present disclosure is to provide a new type of refrigerator, wherein sufficient cool air is supplied into a freezing compartment in which a grill fan assembly is installed, while sufficient cool air is also supplied to an ice making compartment located relatively farther away than the freezing compartment.

Yet another objective of the present disclosure is to provide a new type of refrigerator, wherein fans are commonized and standardized through a design to which fans of the same type and size are applied.

Technical Solution

In a refrigerator according to the present disclosure for achieving the above objectives, a cool air flow path for an ice making compartment for guiding the flow of cool air to the ice making compartment may be formed on a shroud. Therefore, inconvenience of assembling the cool air flow path for the ice making compartment after manufacturing the same as a separate duct may be eliminated.

Furthermore, in the refrigerator according to the present disclosure, the cool air flow path for the ice making compartment may be formed on a shroud, and a cool air flow path for a freezing compartment may be formed on a grill fan. Therefore, the cool air flow path for the ice making compartment and the cool air flow path for the freezing compartment may be defined between the grill fan and the shroud by the operation of intimately coupling the shroud to the grill fan.

Furthermore, the freezing fan module and the ice making fan module may have the same structure. Therefore, commonization of the fan modules may be enabled.

Furthermore, in the refrigerator according to the present disclosure, a second inlet hole for allowing supply of cool air to the ice making compartment may be formed relatively smaller than a first inlet hole for allowing supply of cool air to the freezing compartment. Therefore, cool air may be efficiently supplied to the ice making compartment.

Furthermore, in the refrigerator according to the present disclosure the first inlet hole for allowing supply of cool air to the freezing compartment may be formed to have a size that allows a half or more than a half of an impeller of a freezing fan to be exposed. Therefore, sufficient cool air may be supplied to the freezing compartment through the first inlet hole by blowing action of the freezing fan.

Furthermore, in the refrigerator according to the present disclosure, the second inlet hole for allowing supply of cool air to the ice making compartment may be formed to have a size that allows a half or less than a half of an impeller of an ice making fan to be exposed. Therefore, cool air passing through the second inlet hole may be prevented from flowing back to an evaporator, so that the cool air may be smoothly supplied to the ice making compartment.

Furthermore, in the refrigerator according to the present disclosure, the second inlet hole may be formed to have a size that allows the impeller not to be exposed. Therefore, a blowing pressure of cool air supplied to the ice making compartment may be increased.

Furthermore, in the refrigerator according to the present disclosure, the first inlet hole may be formed in an upper central portion of the shroud. Therefore, the cool air flow path for the freezing compartment may guide the flow of cool air with respect to the portion where the first inlet hole is formed.

Furthermore, in the refrigerator according to the present disclosure, the second inlet hole may be formed beside the first inlet hole. Therefore, the two fan modules may be collectively provided to one grill fan assembly, thereby enabling modularization of the grill fan assembly.

Furthermore, in the refrigerator according to the present disclosure, the cool air flow path for the ice making compartment may be defined by a flow path rib protruding from a front surface of the shroud. Therefore, a portion where the ice making fan module is installed may be isolated from a portion where the freezing fan module is installed, while enabling the flow of cool air to the ice making compartment to be efficiently guided.

Furthermore, in the refrigerator according to the present disclosure, the flow path rib defining the cool air flow path for the ice making compartment may include a first circumferential flow path rib surrounding the upper circumference of the ice making fan module, and a second circumferential flow path rib surrounding the lower circumference of the ice making fan module. Therefore, the flow of cool air developed by the operation of the ice making fan may be formed toward the circumferential direction of the ice making fan thereby being efficiently supplied to a communication portion with the cool air duct for the ice making compartment located beside the ice making fan.

Furthermore, in the refrigerator according to the present disclosure, the flow path rib defining the cool air flow path for the ice making compartment may include a straight flow path rib extending to a side of the shroud. Therefore, cool air flowing in the circumferential direction of the ice making fan may be efficiently supplied along the straight flow path rib. to the communication portion with the cool air duct for the ice making compartment.

Furthermore, in the refrigerator according to the present disclosure, the first and second circumferential flow path ribs may be arranged spaced apart from each other. Therefore, the flow of cool air through a space between the two flow paths may be enabled.

Furthermore, in the refrigerator according to the present disclosure, a part of cool air blown by the operation of the ice making fan module may be supplied to the cool air flow path for the freezing compartment. Therefore, cool air from the freezing compartment may be prevented from flowing back through the second inlet hole when the ice making fan is operated solely.

Furthermore, in the refrigerator according to the present disclosure, a main cool air outlet may be formed above the freezing fan module. Therefore, air flowing in the circumferential direction of the freezing fan may be efficiently discharged through the main cool air outlet.

Furthermore, in the refrigerator according to the present disclosure, the main cool air outlet may be formed to extend across a portion where an upper end of the freezing fan module is located. Therefore, cool air flowing by the freezing fan may be efficiently discharged through the main cool air outlet.

Furthermore, in the refrigerator according to the present disclosure, a space between the first and second circumferential flow path ribs may be formed in a direction toward the main cool air outlet. Therefore, a part of cool air blown by the operation of the ice making fan may be efficiently supplied to the freezing compartment.

Furthermore, in the refrigerator according to the present disclosure, an auxiliary cool air outlet may be formed in the grill fan. Therefore, cool air may be supplied to an intermediate space of the freezing compartment.

Furthermore, in the refrigerator according to the present disclosure, the auxiliary cool air outlet may include a first auxiliary cool air outlet and a second auxiliary cool air outlet. Therefore, cool air may be discharged toward opposite side walls of the freezing compartment.

Furthermore, in the refrigerator according to the present disclosure, the auxiliary cool air outlet may include a third auxiliary cool air outlet for allowing discharge of cool air toward the opposite side walls of the freezing compartment. Therefore, cool air may be discharged toward the opposite side walls of the freezing compartment.

Furthermore, in the refrigerator according to the present disclosure, the third auxiliary cool air outlet may be configured as a grill body with opposite sides open. Therefore, cool air flowing along the cool air flow path for the freezing compartment and guided into the third auxiliary cool air outlet may be efficiently discharged toward the opposite side walls of the freezing compartment.

Furthermore, in the refrigerator according to the present disclosure, a front surface of the third auxiliary cool air outlet may be formed to be inclined toward the opposite sides thereof so as to protrude forward with respect to a predetermined reference portion thereof. Therefore, cool air guided into the third auxiliary cool air outlet may efficiently flow toward the opposite sides thereof.

Furthermore, in the refrigerator according to the present disclosure, the amounts of cool air discharged through the opposite sides of the third auxiliary cool air outlet may be different from each other. Therefore, the required amount of cool air supplied through the opposite sides of the third auxiliary cool air outlet may be controlled.

Furthermore, in the refrigerator according to the present disclosure, the third auxiliary cool air outlet may be configured so that of cool air discharged through the opposite sides thereof, a part of the cool air discharged to a communication portion communicating with a recovery duct for the ice making compartment may be larger in discharge amount than a remaining part of the cool air. Therefore, a problem, in which the increased temperature of cool air recovered through the recovery duct for the ice making compartment causes a rapid increase in the temperature in the freezing compartment, may be prevented.

Furthermore, in the refrigerator according to the present disclosure, a guide may be formed on the front surface of the shroud. Therefore, cool air flowing along the cool flow path for the freezing compartment may be efficiently supplied to each auxiliary cool air outlet.

Furthermore, in the refrigerator according to the present disclosure, a receiving guide may be formed on a rear surface of the grill fan. Therefore, with each guide received in the receiving guide, leakage of cool air through a gap between the rear surface of the grill fan and a surface of the guide may be prevented.

Advantageous Effects

As described above, in the refrigerator according to the present disclosure, the cool air flow path for the freezing compartment and the cool air flow path for the ice making compartment are respectively defined by coupling of the shroud and the grill fan, thereby providing an effect of simplifying the overall structure of the grill fan assembly.

Furthermore, in the refrigerator according to the present disclosure, the first inlet hole and the second inlet hole is formed in the shroud and the freezing fan module and the ice making fan module are installed in the respective inlet holes, thereby providing an effect of simplifying the overall structure of the grill fan assembly.

Furthermore, in the refrigerator according to the present disclosure, the third auxiliary air outlet is formed in consideration of cool air recovered from the ice making compartment to the freezing compartment, thereby providing an effect of achieving a uniform temperature distribution in the freezing compartment and achieving accurate temperature control for the freezing compartment.

Furthermore, in the refrigerator of the present disclosure, through the optimal design of the first inlet hole and the second inlet hole formed in the shroud 100, it is possible to provide an effect of supplying sufficient cool air to the freezing compartment while supplying sufficient cool air also to the ice making compartment located relatively farther away than the freezing compartment.

Furthermore, in the refrigerator according to the present disclosure, the position of the respective inlet holes and the shape of the respective bell mouth are designed in a structure for applying the same type and size of the blowing fans, thereby providing an effect of commonizing and standardizing the blowing fans.

Furthermore, in the refrigerator according to the present disclosure, the shared flow path and the supply flow path are formed in the cool air flow path for the ice making compartment, thereby providing an effect of preventing a phenomenon in which cool air in the freezing compartment flows back into the cool air flow path for the ice making compartment even when the blowing fan is operated solely.

MODE FOR INVENTION

Hereinafter, a refrigerator according to an exemplary embodiment of the present disclosure will be described with reference to FIGS. 1 to 27.

Figure 1:
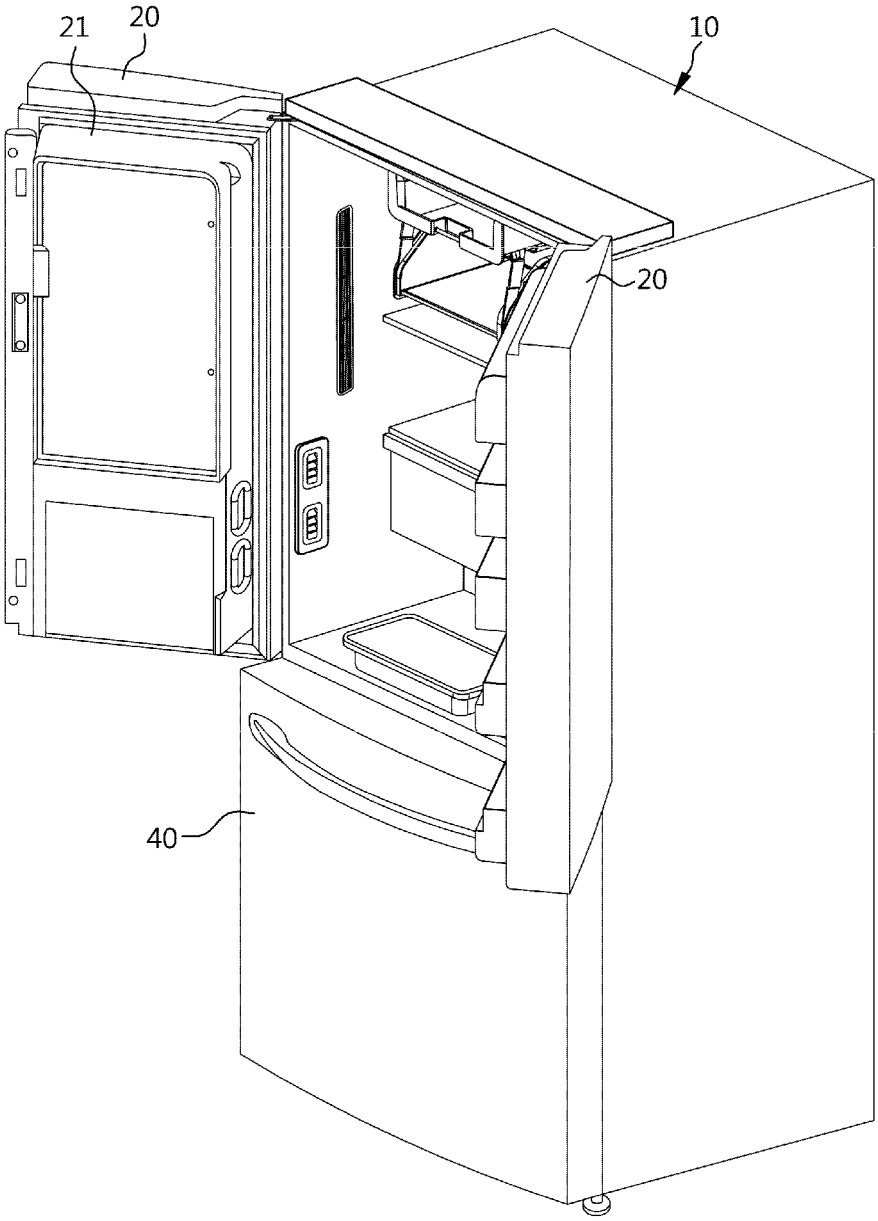
FIG. 1 is a perspective view illustrating the external structure of a refrigerator according to an embodiment of the present disclosure.
Figure 2:
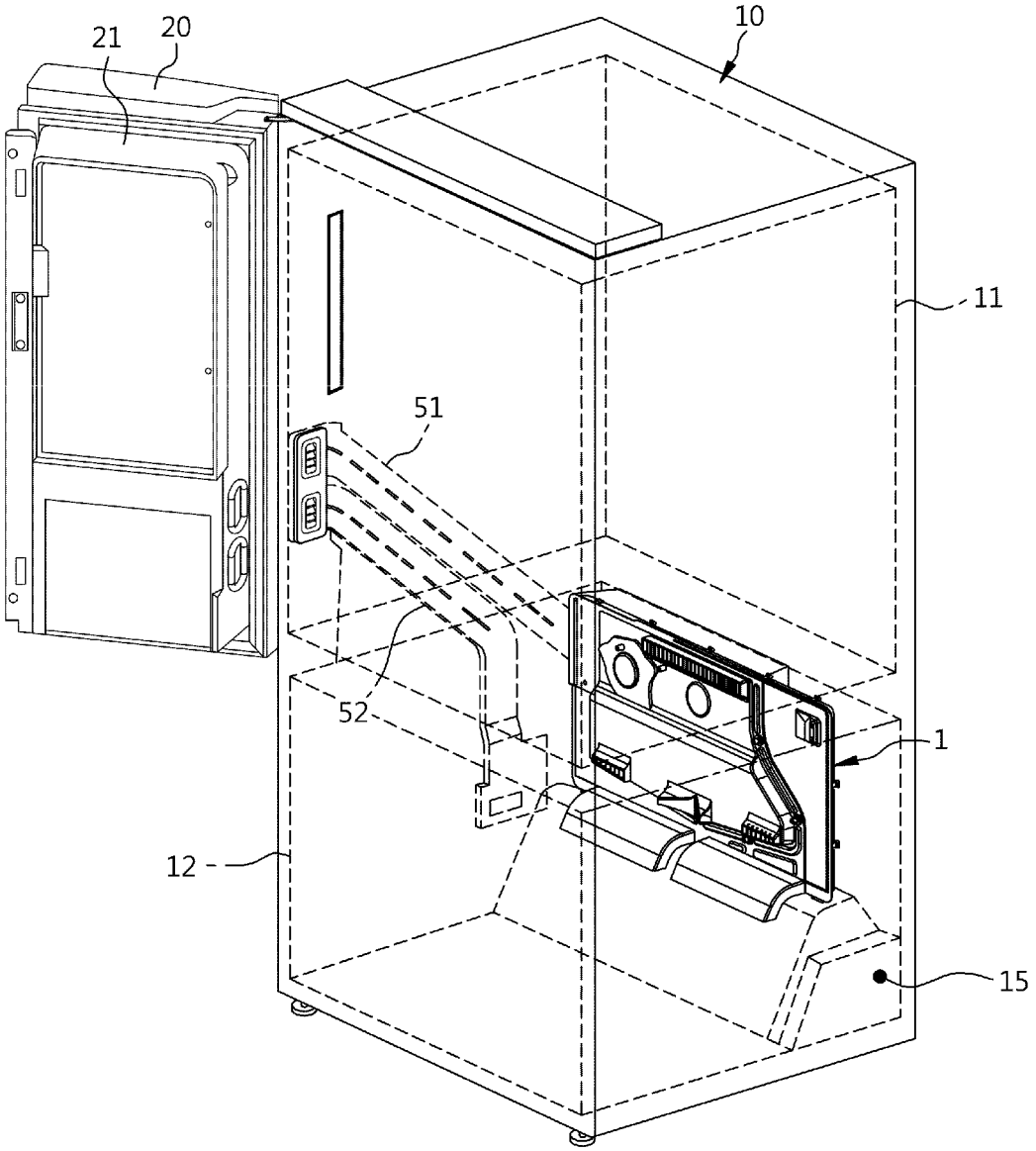
FIG. 2 is a schematic perspective view illustrating the internal structure of the refrigerator according to the embodiment of the present disclosure.
Figure 3:
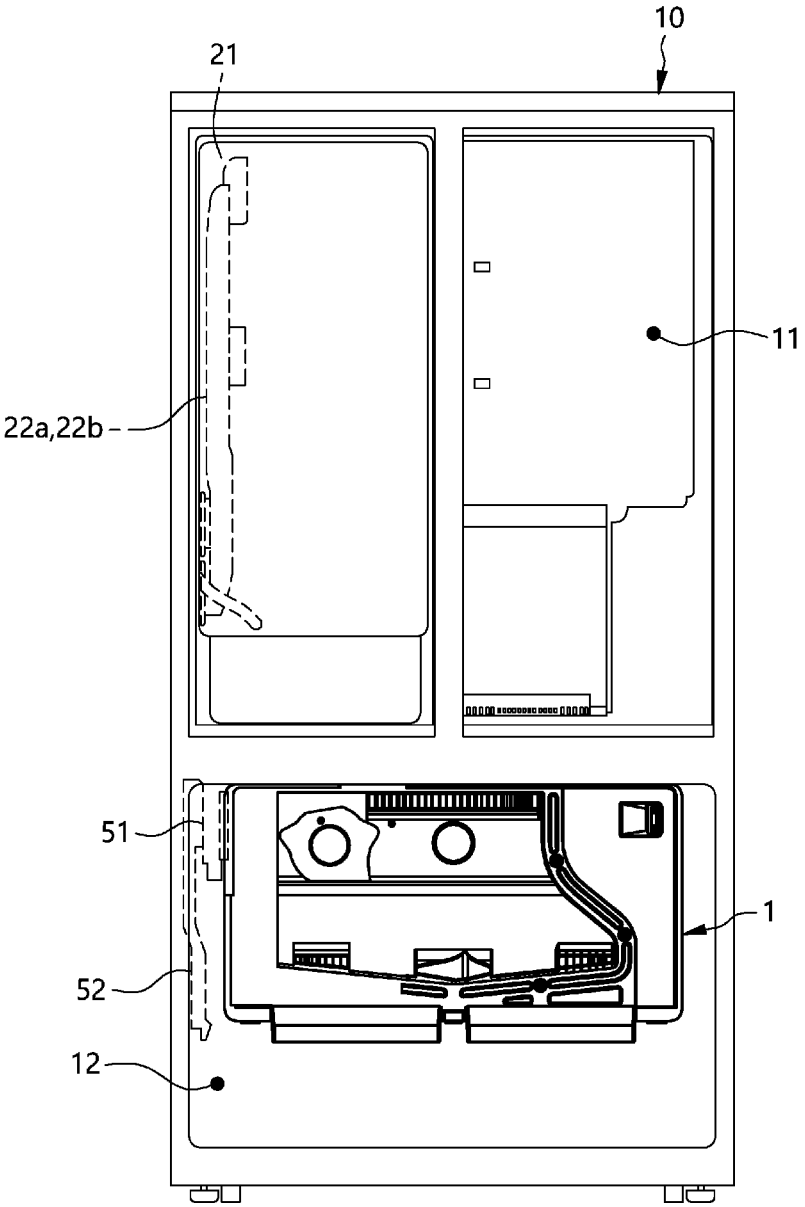
FIG. 3 is a schematic front sectional view illustrating the internal structure of the refrigerator according to the embodiment of the present disclosure.
Figure 4:
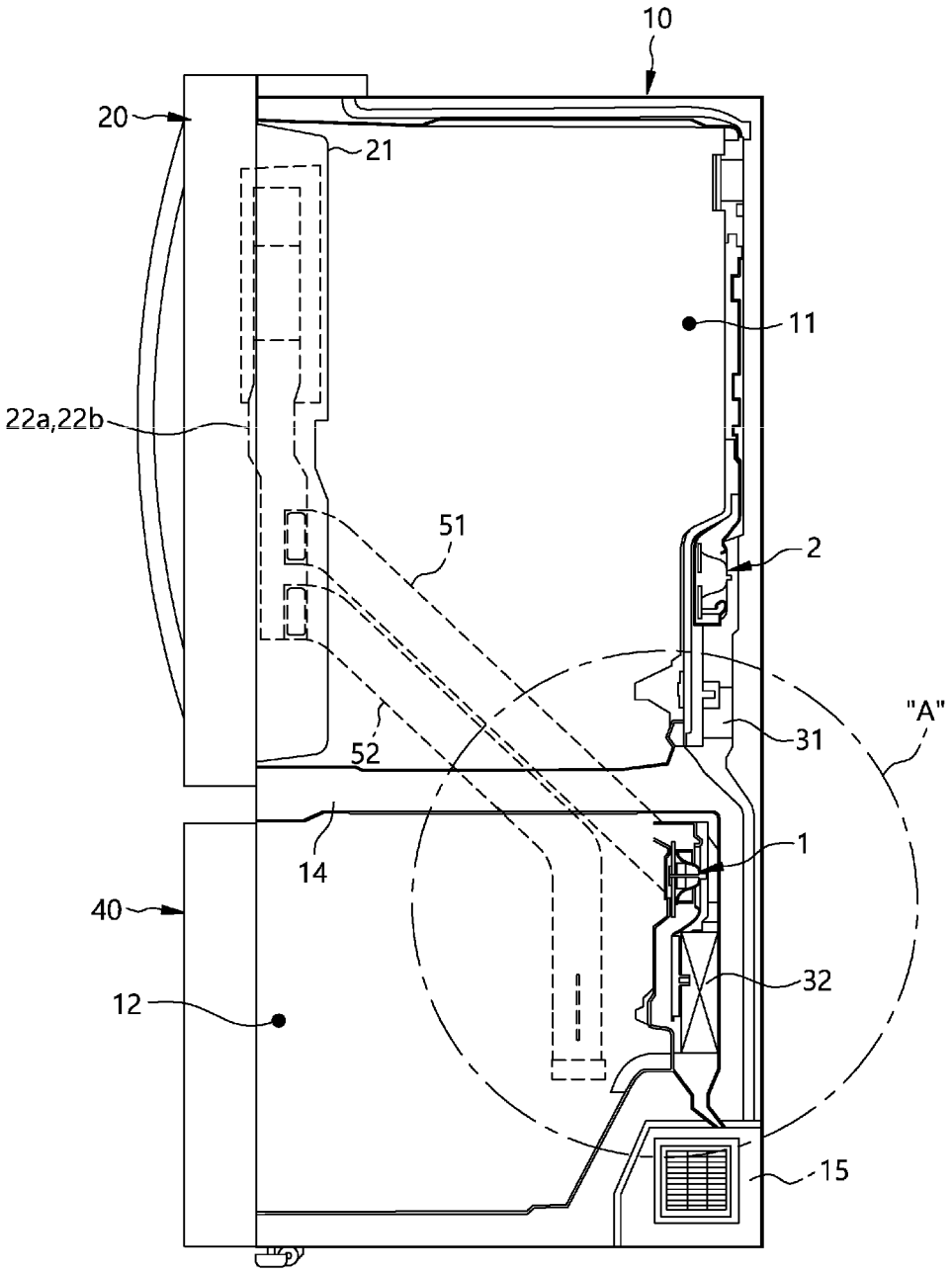
FIG. 4 is a schematic side sectional view illustrating the internal structure of the refrigerator according to the embodiment of the present disclosure.

FIG. 1 is a perspective view illustrating the external structure of a refrigerator according to an embodiment of the present disclosure, FIG. 2 is a schematic perspective view illustrating the internal structure of the refrigerator according to the embodiment of the present disclosure, FIG. 3 is a schematic front sectional view illustrating the internal structure of the refrigerator according to the embodiment of the present disclosure, and FIG. 4 is a schematic side sectional view illustrating the internal structure of the refrigerator according to the embodiment of the present disclosure.

As illustrated in these drawings, a freezing compartment-side grill fan assembly 1 of the refrigerator according to the embodiment of the present disclosure may be a structure that is applied to a freezing compartment 12 of the refrigerator including a refrigerating compartment 11, the freezing compartment 12, and an ice making compartment 21.

In particular, the freezing compartment-side grill fan assembly 1 may include two fan modules 410 and 420 (freezing fan module and ice making fan module) and may be configured to selectively supply cool air heat-exchanged through a second evaporator 32 to the freezing compartment 12 and the ice making compartment 21.

That is, the two fan modules 410 and 420 may be collectively provided to a single freezing compartment-side grill fan assembly 1, and a structure for guiding the flow of cool air blown by each of the fan modules 410 and 420 may be integrally formed on the freezing compartment-side grill fan assembly 1.

Prior to the description of this embodiment, as illustrated in FIGS. 1 to 4, the refrigerator according to the embodiment of the present disclosure to which the freezing compartment-side grill fan assembly 1 is applied may largely include: a cabinet 10 including the refrigerating compartment 11 and the freezing compartment 12; and a refrigerator compartment door 20 including the ice making compartment 21.

The refrigerating compartment 11 may be a storage compartment provided for cold storage of stored items and may be opened and closed by the refrigerating compartment door 20, and the freezing compartment 12 may be a storage compartment provided for freezing storage of stored items and may be opened and closed by a freezing compartment door 40.

Figure 5:
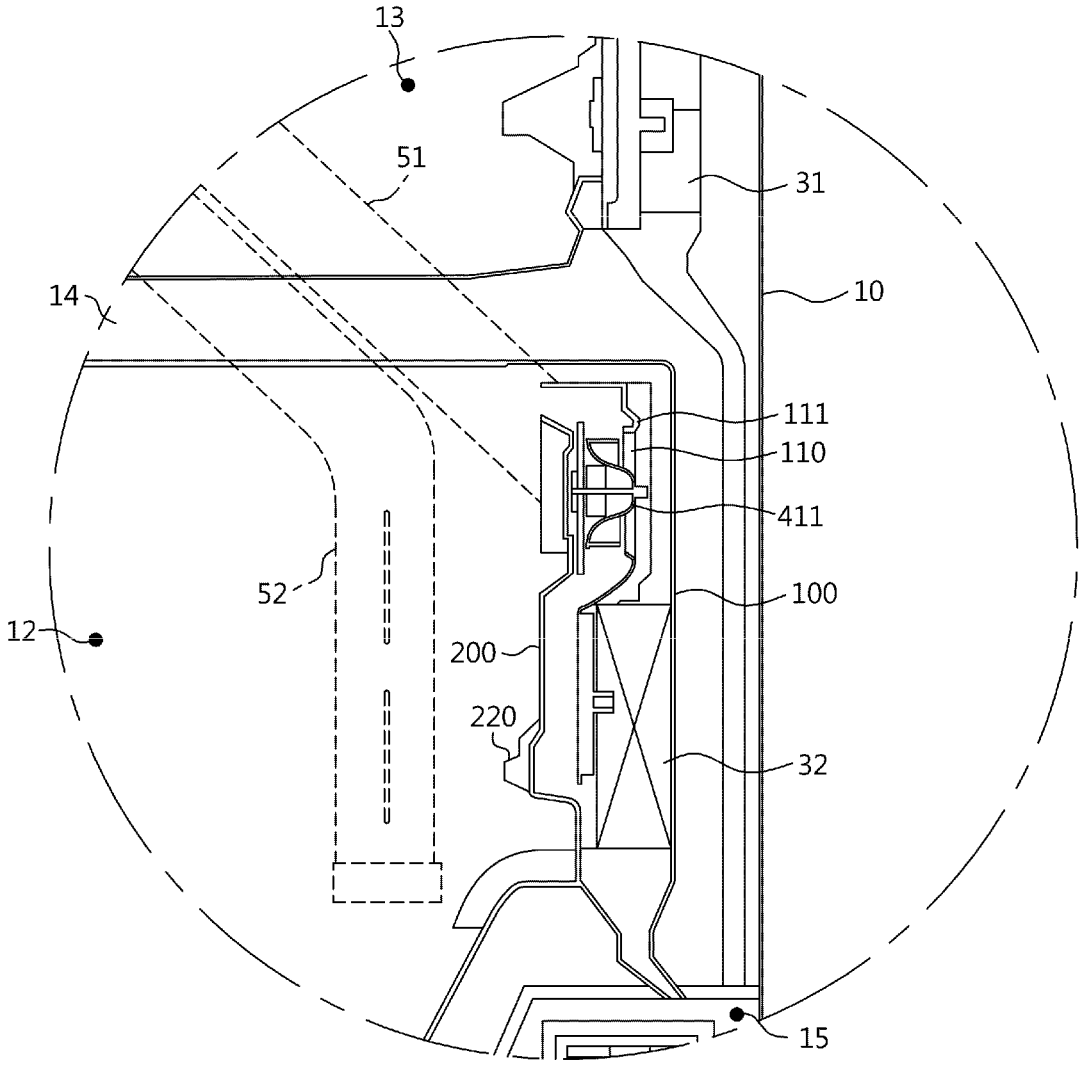
FIG. 5 is an enlarged view of "A" part in FIG. 4

A first evaporator 31 may be provided at a rear portion of the refrigerating compartment 11 on an inner rear wall of the cabinet 10, and a second evaporator 32 may be provided at a rear portion of the freezing compartment 12 on the inner rear wall of the cabinet 10. The first evaporator 31 may be an evaporator provided to supply cool air to the refrigerating compartment 11, and the second evaporator 32 may be an evaporator provided to supply cool air to the freezing compartment 12 and the ice making compartment 21. This is as illustrated in FIGS. 4 and 5.

The refrigerating compartment 11 may be defined in an upper space in the cabinet 10, and the freezing compartment 12 may be defined in a lower space in the cabinet 10. These respective storage compartments (refrigerating compartment 11 and freezing compartment 12) may be isolated from each other by a partition wall 14 that partitions the space in the cabinet 10 into the upper and lower spaces.

The refrigerating compartment door 20 may be a door for opening and closing the refrigerating compartment 11 and may be configured as a rotary door.

In particular, the ice making compartment 21 may be installed on an inner side (a side located inside the refrigerating compartment when the refrigerating compartment door is closed) of the refrigerating compartment door 20. The ice making compartment 21 may be a storage compartment which is on the refrigerating compartment door 20 and in which an ice tray (not illustrated) for ice making is provided.

The freezing compartment-side grill fan assembly 1 and a refrigerating compartment-side grill fan assembly 2 may be provided in front of the evaporators 32 and 31 in the cabinet 10, respectively.

The freezing compartment-side grill fan assembly 1 of the refrigerator according to the embodiment of the present disclosure may have a structure different from that of the refrigerating compartment-side grill fan assembly 2 provided in the refrigerating compartment 11. That is, the refrigerating compartment-side grill fan assembly 2 provided in the refrigerating compartment 11 may include only one fan module, whereas the freezing compartment-side grill fan assembly 1 provided in the freezing compartment 12 of the refrigerator according to the embodiment of the present disclosure may include the two fan modules 410 and 420 collectively installed and may be configured to selectively supply cool air to the freezing compartment 12 and the ice making compartment 21.

Figure 7:
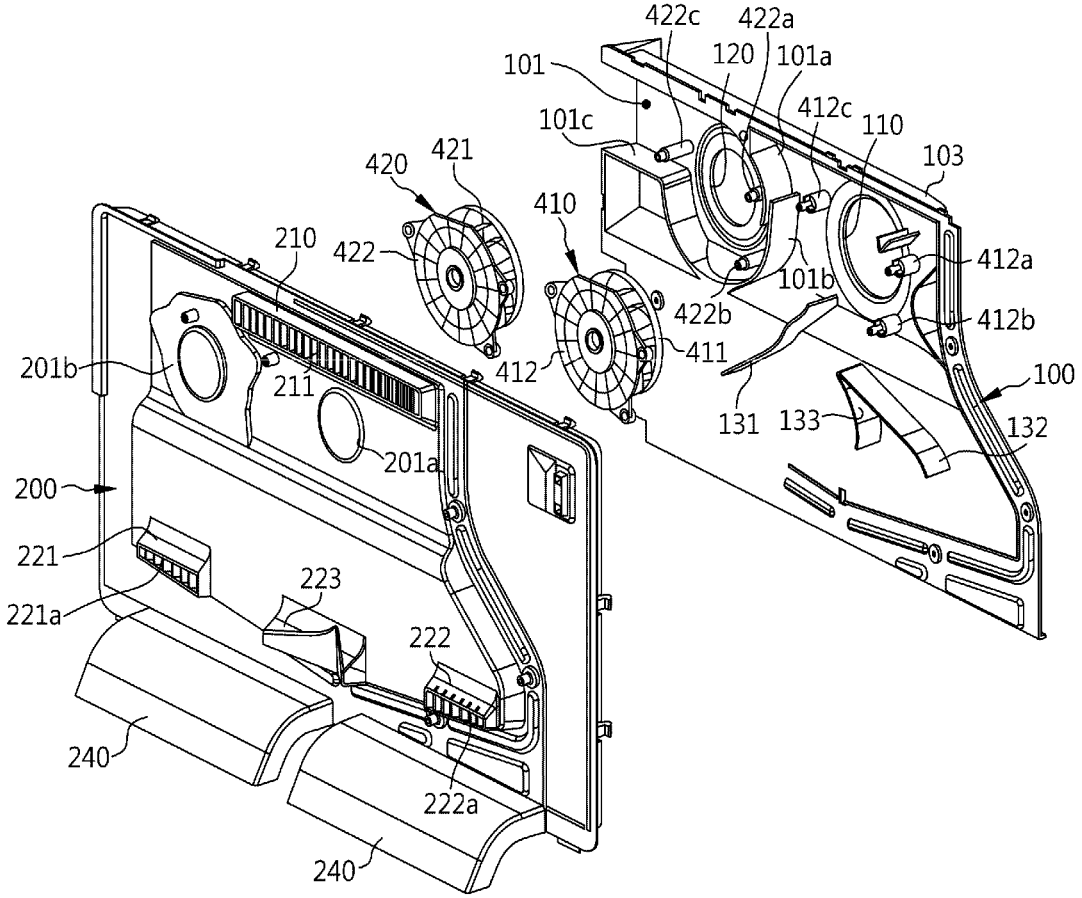
FIG. 7 is an exploded perspective view illustrating a freezing compartment-side grill fan assembly of the refrigerator according to the embodiment of the present disclosure.

As illustrated in FIG. 7, the freezing compartment-side grill fan assembly 1 of the refrigerator according to the embodiment of the present disclosure may largely include a shroud 100, a grill fan 200, the freezing fan module 410, and the ice making fan module 420. In particular, two inlet holes 110 and 120 in which the two fan modules 410 and 420 are installed may be collectively formed in a single shroud 100, and the overall height of the freezing compartment-side grill fan assembly 1 may be minimized by improving the structure of respective cool air flow paths 101 and 201.

Figure 8:
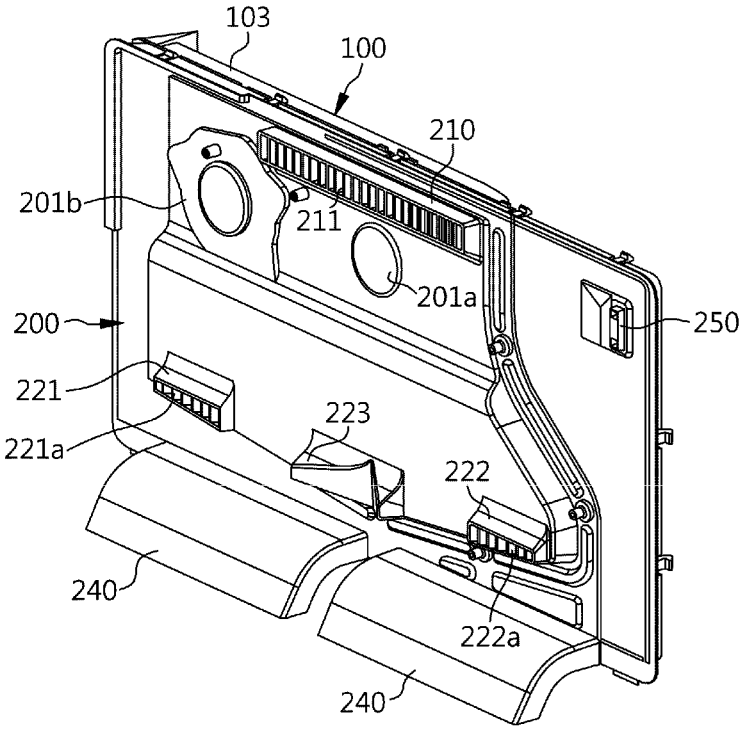
FIG. 8 is a combined perspective view illustrating the freezing compartment-side grill fan assembly of the refrigerator according to the embodiment of the present disclosure.

FIG. 8 is a combined perspective view illustrating a state in which the shroud 100 of the freezing compartment-side grill fan assembly 1 of the refrigerator according to the embodiment of the present disclosure and the grill fan 200 are coupled to each other.

The freezing compartment-side grill fan assembly 1 will be described in more detail for each configuration as follows.

First, the shroud 100 will be described.

Figure 9:
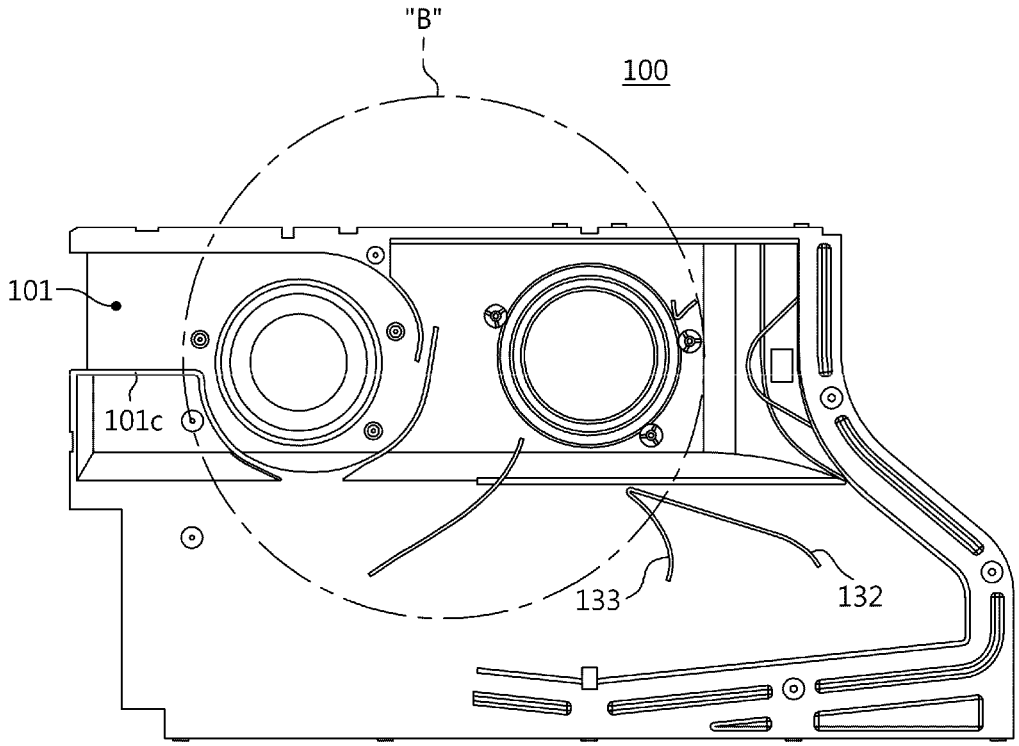
FIG. 9 is a front view illustrating a shroud of the freezing compartment-side grill fan assembly of the refrigerator according to the embodiment of the present disclosure.
Figure 10:
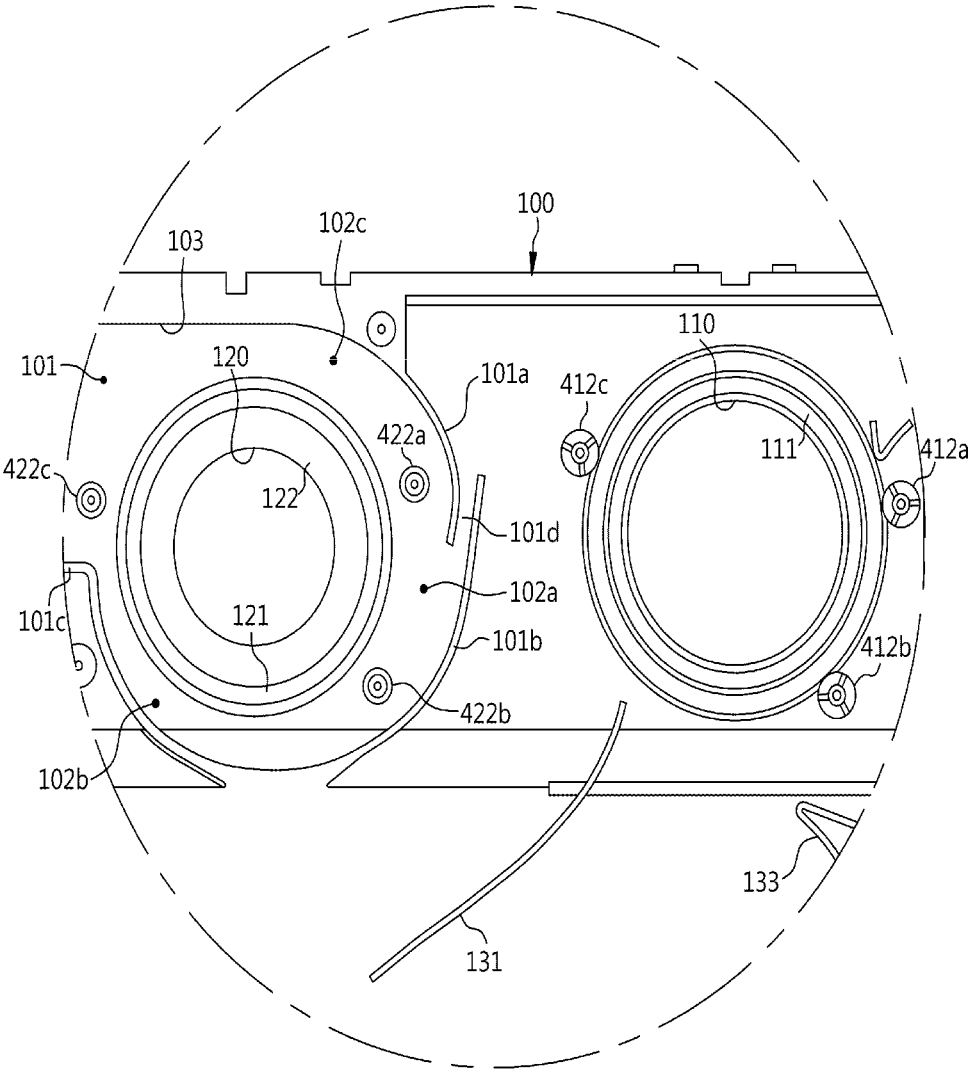
FIG. 10 is an enlarged view of "B" part in FIG. 9.
Figure 11:
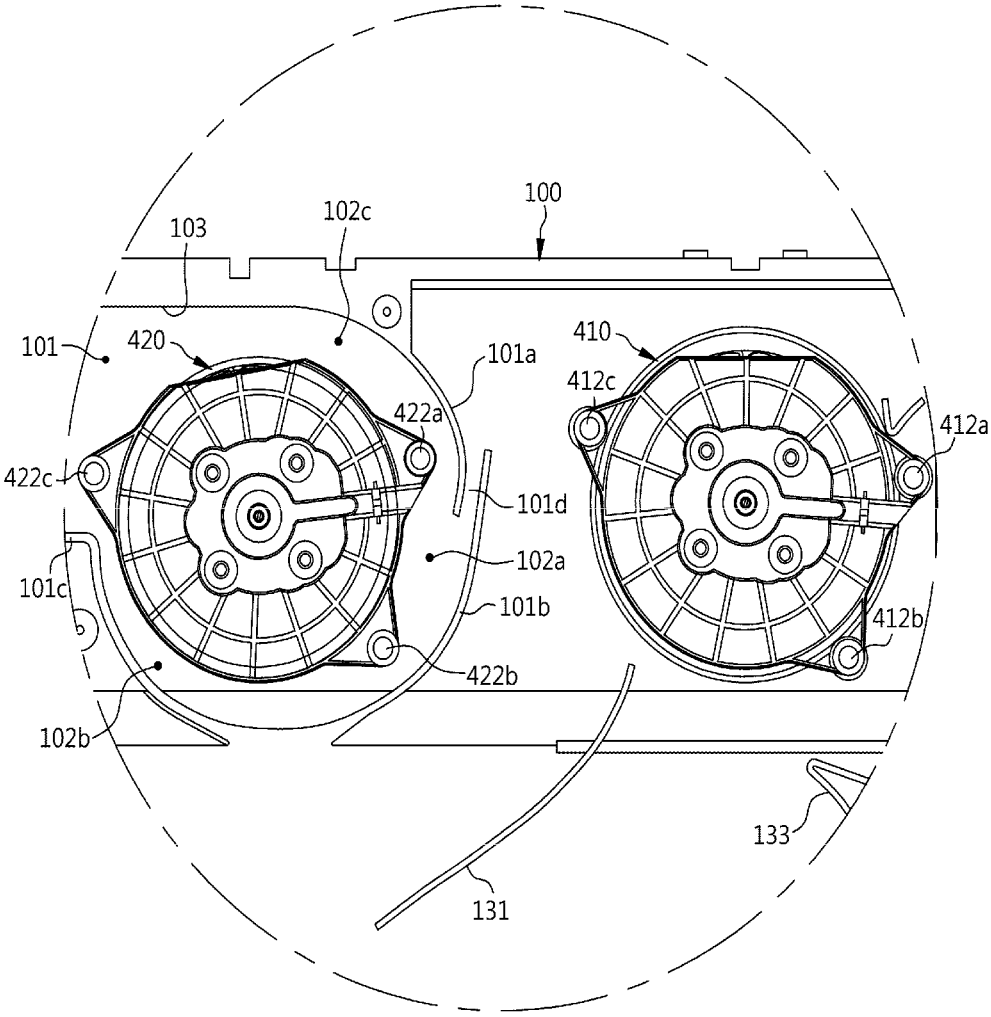
FIG. 11 is a state view of main parts illustrating an example of a state in which a freezing fan module and an ice making fan module are installed at a grill fan illustrated in FIG. 10.
Figure 12:
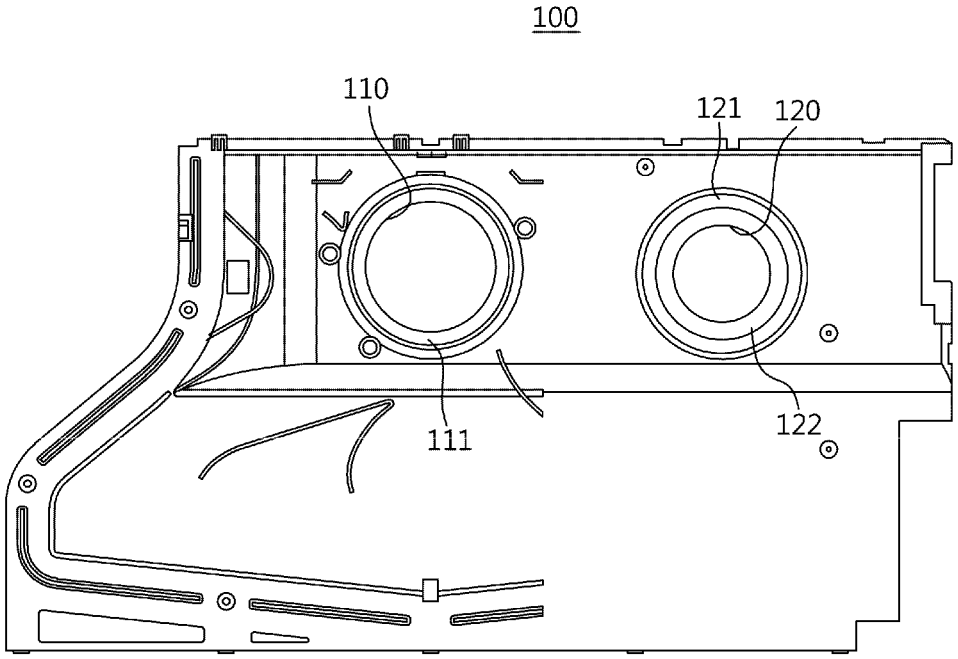
FIG. 12 is a rear view illustrating the shroud of the refrigerator according to the embodiment of the present disclosure.
Figure 13:
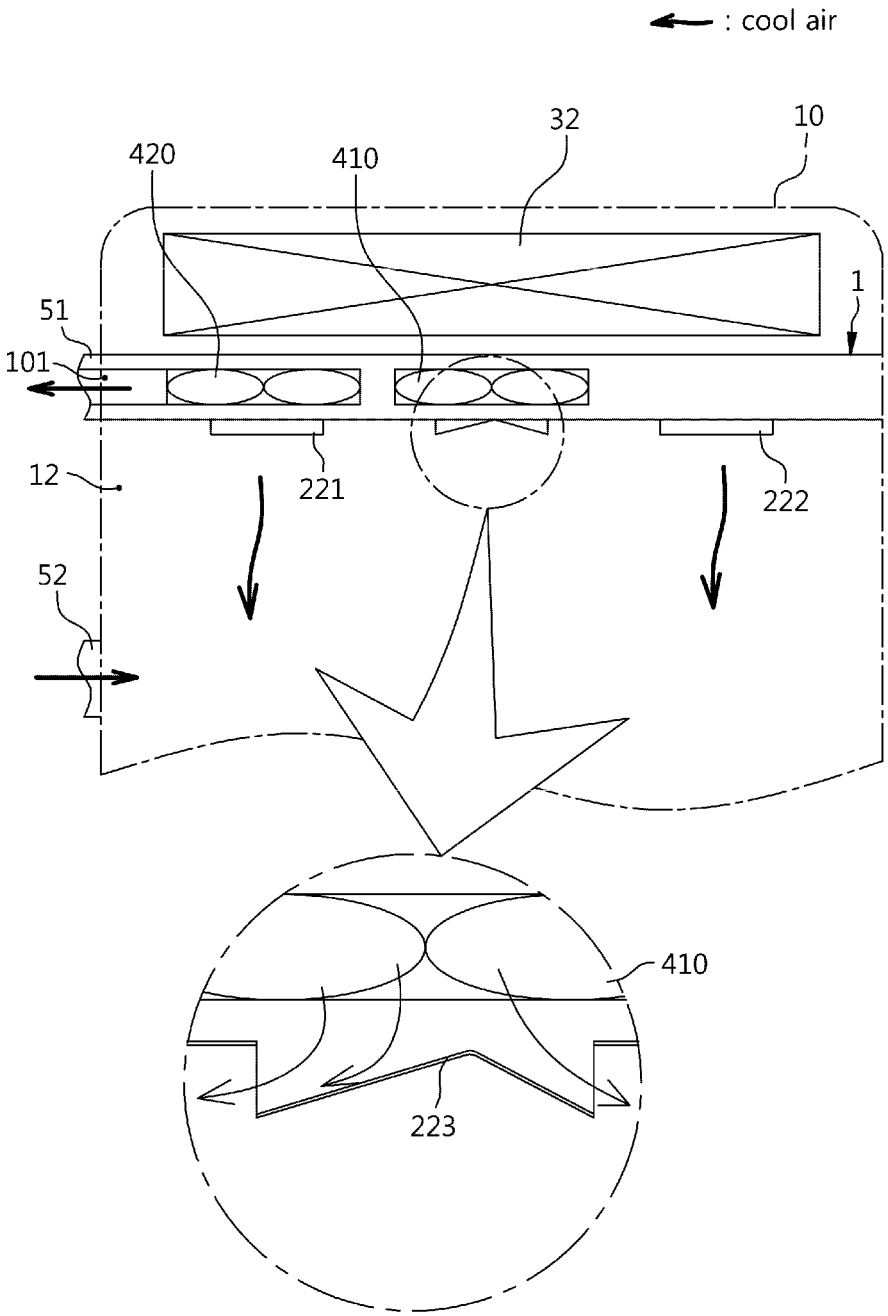
FIG. 13 is a schematic plan view illustrating a flow state of cool air by each auxiliary cool air outlet of the refrigerator according to the embodiment of the present disclosure.

FIG. 9 is a front view illustrating a shroud of the freezing compartment-side grill fan assembly of the refrigerator according to the embodiment of the present disclosure, FIG. 10 is an enlarged view of "B" part in FIG. 9, FIG. 11 is a state view of main parts illustrating an example of a state in which a freezing fan module and an ice making fan module are installed at a grill fan illustrated in FIG. 10, and FIG. 12 is a rear view illustrating the shroud of the refrigerator according to the embodiment of the present disclosure.

As illustrated in these drawings, the shroud 100 may be a part that defines a rear wall of the freezing compartment-side grill fan assembly 1.

The second evaporator 32 may be located at the rear portion of the freezing compartment 12 on the inner rear wall of the cabinet 10, and the shroud 100 may be located in front of the second evaporator 32.

The shroud 100 may include the first inlet hole 110 and the second inlet hole 120 formed therethrough.

The two inlet holes 110 and 120 may be holes which are formed to allow cool air heat-exchanged through the second evaporator 32 located at the rear portion of the freezing compartment 12 to be introduced into the space between the grill fan 200 and the shroud 100.

The freezing fan module 410 may be installed at a portion of a front surface of the shroud 100 where the first inlet hole 110 is formed, and the ice making fan module 420 may be installed at a portion of the front surface of the shroud 100 where the second inlet hole 120 is formed.

The freezing fan module 410 may be located to face the first inlet hole 110, and the ice making fan module 420 may be located to face the second inlet hole 120.

A first bell mouth 111 may be provided around the circumference of the first inlet hole 110, and a second bell mouth 121 may be provided around the circumference of the second inlet hole 120.

Meanwhile, the first inlet hole 110 may be designed in consideration of the air volume of cool air supplied to the freezing compartment 12 through the freezing fan module 410, and the second inlet hole 120 may be designed in consideration of the pressure of cool air supplied to the ice making compartment 21.

That is, the freezing fan module 410 may be configured to supply a sufficient amount of cool air because the freezing fan module 410 may supply cool air to the freezing compartment 12 located in front thereof, whereas the ice making fan module 420 may be configured to supply a sufficient amount of cool air to a distant space because the ice making fan module 420 may supply cool air to the ice making compartment 21 located at the refrigerating compartment door 20.

To this end, the first inlet hole 110 may be formed relatively larger than the second inlet hole 120 so that a blowing pressure of cool air passing therethrough is low, but the discharge amount thereof is large, whereas the second inlet hole 120 may be formed relatively smaller than the first inlet hole 110 so that the discharge amount of cool air may be small, but a blowing pressure of cool air passing therethrough may be high enough that the cool air is supplied to the ice making compartment 21. This is as illustrated in FIGS. 9 and 10.

The first inlet hole 110 may be formed to have an inner diameter that allows about a half or more than a half of each impeller 411*c* of a freezing fan 411 constituting the freezing fan module 410 to be exposed.

That is, cool air passing through the first inlet hole 110 may be introduced between respective impellers 411*c* and discharged directly in the radial direction under guidance of the impellers 411*c*.

In another example, the first inlet hole 110 may be formed to have an inner diameter that allows a substantial entirety of each impeller 411*c* of the freezing fan 411 to be exposed.

Figure 16:
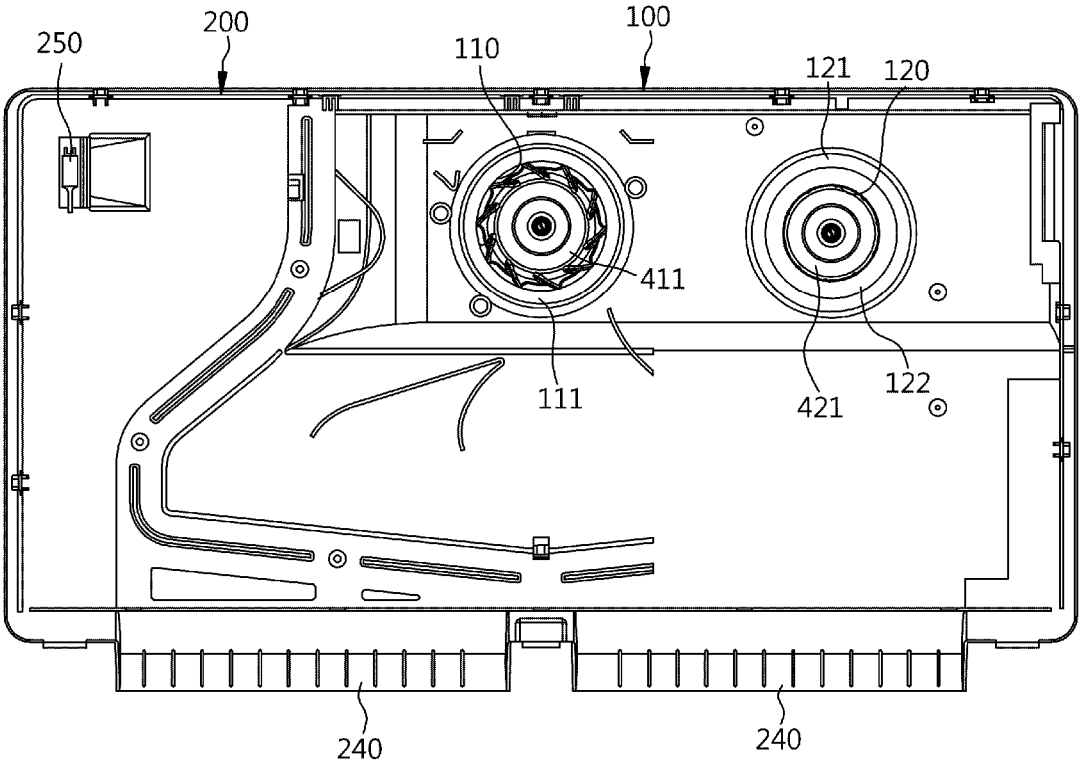
FIG. 16 is a rear view illustrating a state in which the shroud is coupled to the grill fan of the refrigerator according to the embodiment of the present disclosure.

On the contrary, the second inlet hole 120 may be formed to allow each impeller 421*c* of an ice making fan 421 not to be exposed as much as possible (see FIG. 16).

That is, the more each impeller 421*c* of the ice making fan 421 may be exposed through the second inlet hole 120, the more back flow through the second inlet hole 120 may be generated while cool air may be discharged in the rotational direction of the ice making fan 421. As a result, a phenomenon in which the flow flowing back through the second inlet hole 120 and the flow flowing into the second inlet hole 120 from the second evaporator 32 collide with each other may occur, with the result that a blowing pressure of cool air toward the cool air flow path 101 for the ice making compartment may be reduced.

In this case, by forming the second inlet hole 120 to have a size that allows a half or less than a half of each impeller 421*c* to be exposed, the blowing pressure may be increased.

In another example, the second inlet hole 120 may be formed to have a size that allows each impeller 421*c* not to be exposed. That is, a substantial entirety of an open gap between each of respective impellers 421*c* may be covered so that the back flow of cool air may be fundamentally prevented.

A covering member 122 may be additionally provided on an inner circumferential surface of the second inlet hole 120. That is, through the additional provision of the covering member 122, the second inlet hole 120 may cover the respective impellers 421*c* of the ice making fan 421 while having a relatively smaller opening than the first inlet hole 110.

In particular, the covering member 122 may cover the respective impellers 421*c* of the ice making fan 421 constituting the ice making fan module 420 so as not to be exposed through the second inlet hole 120, so that cool air passing through the second inlet hole 120 and flowing into the cool air flow path 101 for the ice making compartment in the freezing compartment-side grill fan assembly 1 may be supplied to the ice making compartment 21 along the cool air flow path 101 for the ice making compartment under increased blowing pressure, without being discharged back through the second inlet hole 120.

The shroud 100 may include the cool air flow path 101 for the ice making compartment.

Figure 6:
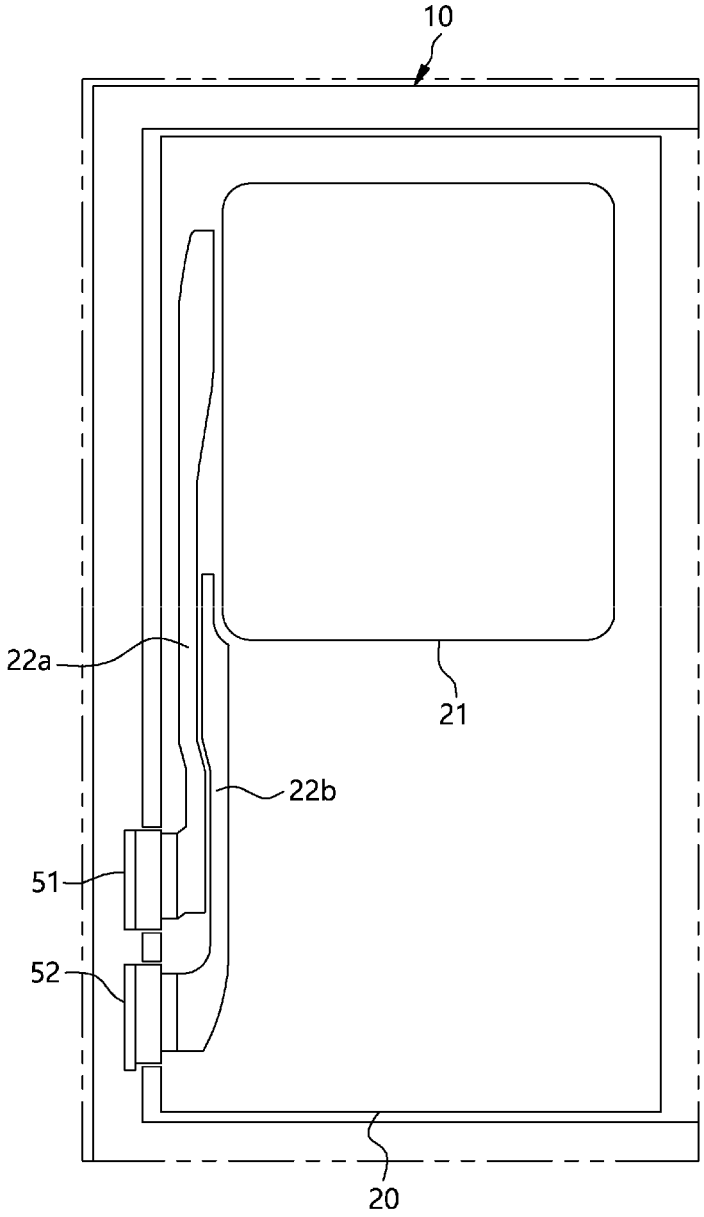
FIG. 6 is an enlarged view of main parts illustrating an application state of a structure for supplying or recovering cool air to an ice making compartment of the refrigerator according to the embodiment of the present disclosure.

The cool air flow path 101 for the ice making compartment may be a flow path that guides cool air introduced between the shroud 100 and the grill fan 200 through the second inlet hole 120 to flow to the junction with a cool air duct 51 for the ice making compartment (see FIG. 6). The cool air duct 51 for the ice making compartment may be installed to pass through one side (a side where the refrigerating compartment door with the ice making compartment is located) of the shroud 100.

In addition, the cool air duct 51 for the ice making compartment may be installed along an inner side wall of the cabinet 10. In particular, the cool air duct 51 for the ice making compartment may have a first end connected to the cool air flow path 101 for the ice making compartment, and a second end located to be exposed to an inner wall of the refrigerating compartment 11.

The cool air duct 51 for the ice making compartment may be configured such that when the refrigerating compartment door 20 with the ice making compartment 21 is closed, the second end thereof is matched to a supply guide duct 22*a* formed in the refrigerating compartment door 20, thereby allowing cool air to be supplied to the supply guide duct 22*a*. The supply guide duct 22*a* may extend to the ice making compartment 21 to allow supply of the cool air to the ice making compartment 21 therethrough.

The refrigerating compartment door 20 may further include a recovery guide duct 22*b*. The recovery guide duct 22*b* may have a first end connected to the ice making compartment 2, and a second end extending to a lower side of a side wall of the refrigerating compartment door 20, and may be configured to guide a recovery flow of cool air flowing through the ice making compartment 21.

The recovery guide duct 22*b* may be configured such that when the refrigerating compartment door 20 is closed, the second end thereof is matched to a first end of a recovery duct 52 for the ice making compartment provided along a side wall of the refrigerating compartment 11, thereby allowing the recovery flow of cool air to be supplied to the recovery duct 52 for the ice making compartment to the freezing compartment 12. The recovery duct 52 for the ice making compartment may be connected to a side wall of the freezing compartment 12 at a second end thereof so as to communicate with the freezing compartment 12.

The cool air flow path 101 for the ice making compartment may be defined by flow path ribs 101*a*, 101*b*, and 101*c* protruding from the front surface of the shroud 100.

The flow path ribs 101*a*, 101*b*, and 101*c* may be formed to protrude from the front surface of the shroud 100 thereby defining respective walls of the cool air flow path 101 for the ice making compartment. That is, the flow of cool air introduced through the second inlet hole 120 may be guided along the cool air flow path 101 defined by the flow path ribs 101*a*, 101*b*, and 101 to the junction of the cool air flow path 101 and the cool air duct 51 for the ice making compartment.

The flow path ribs 101*a*, 101*b*, and 101*c* may include a first circumferential flow path rib 101*a*, a second circumferential flow path rib 101*b*, and a straight flow path rib 101*c*. That is, a portion where the second inlet hole 120 is formed may be isolated from the cool air flow path 201 for the freezing compartment by the three flow path ribs 101*a*, 101*b*, and 101*c*, so that cool air passing through the second inlet hole 120 may be efficiently supplied to the cool air duct 51 for the ice making compartment along the cool air flow path 101 for the ice making compartment defined by the three flow path ribs 101*a*, 101*b*, and 101*c*.

The first circumferential flow path rib 101*a* may be formed to extend across between the first inlet hole 110 and the second inlet hole 120 on the front surface of the shroud 100. That is, the first circumferential flow path rib 101*a* may be formed to separate the ice making fan module 420 and the freezing fan module 410 from each other, so that cool air provided from the freezing fan module 410 may be prevented from being discharged directly to a cool air discharge side of the cool air flow path 101 for the ice making compartment.

In particular, the first circumferential flow path rib 101*a* may be formed to be rounded to surround a portion (a portion located neighboring to the freezing fan module) of the circumference of the ice making fan module 420 installed in the second inlet hole 120. As cool air discharged in the radial direction of the ice making fan 421 by the operation of the ice making fan 421 may flow in the rotational direction of the ice making fan 421 under guidance of the first circumferential flow path rib 101*a*, the cool air may flow under guidance of the straight flow path rib 101*c*.

The second circumferential flow path rib 102*a* may be formed to separate a lower circumference of a portion of the front surface of the shroud 100 where the ice making fan module 420 is installed, from the cool air flow path 201 for the freezing compartment located therebelow. That is, the second circumferential flow path rib 102*a* may separate the lower portion from a central portion between the ice making fan module 420 and the freezing fan module 410.

The second circumferential flow path rib 102*a* may be formed to be rounded to surround a lower portion of the circumference of the ice making fan module 420. As cool air discharged in the radial direction of the ice making fan 421 by the operation of the ice making fan 421 may flow in the rotational direction of the ice making fan 421 under guidance of the second circumferential flow path rib 102*a*, the cool air may flow under guidance of the straight flow path rib 101*c*.

In particular, the first circumferential flow path rib 101*a* and the second circumferential flow path rib 101*b* may be formed to be spaced apart from each other. That is, the first circumferential flow path rib 101*a* and the second circumferential flow path rib 101*b* may be in spaced apart relationship thereby defining a shared flow path 101*d* for allowing the flow of cool air therethrough.

The shared flow path 101*d* may serve to provide a part of cool air flowing along the cool air flow path 101 for the ice making compartment to the cool air flow path 201 for the freezing compartment for supply to the freezing compartment 12.

That is, when the freezing fan 411 and the ice making fan 421 are operated simultaneously, a part of cool air blown by the ice making fan 421 may be additionally supplied to the freezing compartment 12 so that quick control of the temperature of the freezing compartment 12 may be achieved.

In addition, when the ice making fan 421 is operated solely, the pressure at the second inlet hole 120 where the ice making fan 421 is located may be relatively lower than that at the first inlet hole 110. Therefore, there may occur a phenomenon in which cool air in the freezing compartment 12 flows along the cool air flow path 201 for the freezing compartment back to a portion where the second evaporator 32 is located through the first inlet hole 110 and is then introduced into the cool air flow path 101 for the ice making compartment. However, through the provision of the shared flow path 101*d*, cool air between the cool air flow path 201 for the freezing compartment and the cool air flow path 101 for the ice making compartment may be shared, which may reduce the difference in pressure between the two flow paths 101 and 201 even when the ice making fan 421 is operated solely. Therefore, the phenomenon in which the cool air in the freezing compartment 12 flows back into the cool air flow path 101 for the ice making compartment may be prevented.

In particular, the shared flow path 101*d* may be formed to extend in a direction above the portion where the first inlet hole 110 is formed. That is, when considering that a main cool air outlet 210 of the grill fan 200, which will be described later, may be formed above the portion where the first inlet hole 110 is formed, the shared flow path 101*d* may be formed in a direction toward the main cool air outlet 210 so that a part of cool air flowing along the cool air flow path 101 for the ice making compartment may be efficiently supplied to the freezing compartment 12.

The straight flow path rib 101*c* may be formed to extend from the end (the end opposite to the first circumferential flow rib) of the second circumferential flow path rib 101*b* to a side (the junction with the cool air duct for the ice making compartment) of the shroud 100.

That is, by the straight flow path rib 101*c* and a top surface 103 of the shroud 100, cool air flowing in the circumferential direction along the two circumferential flow path ribs 101*a* and 101*b* may flow toward the cool air duct 51 for the ice making compartment.

Meanwhile, the respective flow path ribs 101*a*, 101*b*, and 101*c* may come into intimate contact with a rear surface of the grill fan 200 which will be described later, so that the cool air flow path 101 for the ice making compartment defined by the respective flow path ribs 101*a*, 101*b*, and 101*c* may form a closed flow path closed from the external environment outside the freezing compartment-side grill fan assembly 1.

Although not shown in the drawings, the cool air flow path 101 for the ice making compartment may be formed to protrude from the rear surface of the grill fan 200 toward the front surface of the shroud 100.

The shroud 100 may include a plurality of guides 131, 132, and 133 formed on the front surface thereof.

That is, through the provision of the guides 131, 132, and 133, cool air passing through the first inlet hole 110 may be efficiently supplied to positions where respective auxiliary cool air outlets 221, 222, and 223 are formed.

The guides 131, 132, and 133 may include a first guide 131, a second guide 132, and a third guide 133. The first guide 131 may guide cool air introduced between the grill fan 200 and the shroud 100 through the first inlet hole 110 to flow to a first auxiliary cool air outlet 221.

The second guide 132 may guide cool air introduced between the grill fan 200 and the shroud 100 through the first inlet hole 110 to flow to a second auxiliary cool air outlet 222.

The third guide 133 may guide cool air introduced between the grill fan 200 and the shroud 100 through the first inlet hole 110 to flow to a third auxiliary cool air outlet 223.

Next, the grill fan 200 will be described.

Figure 14:
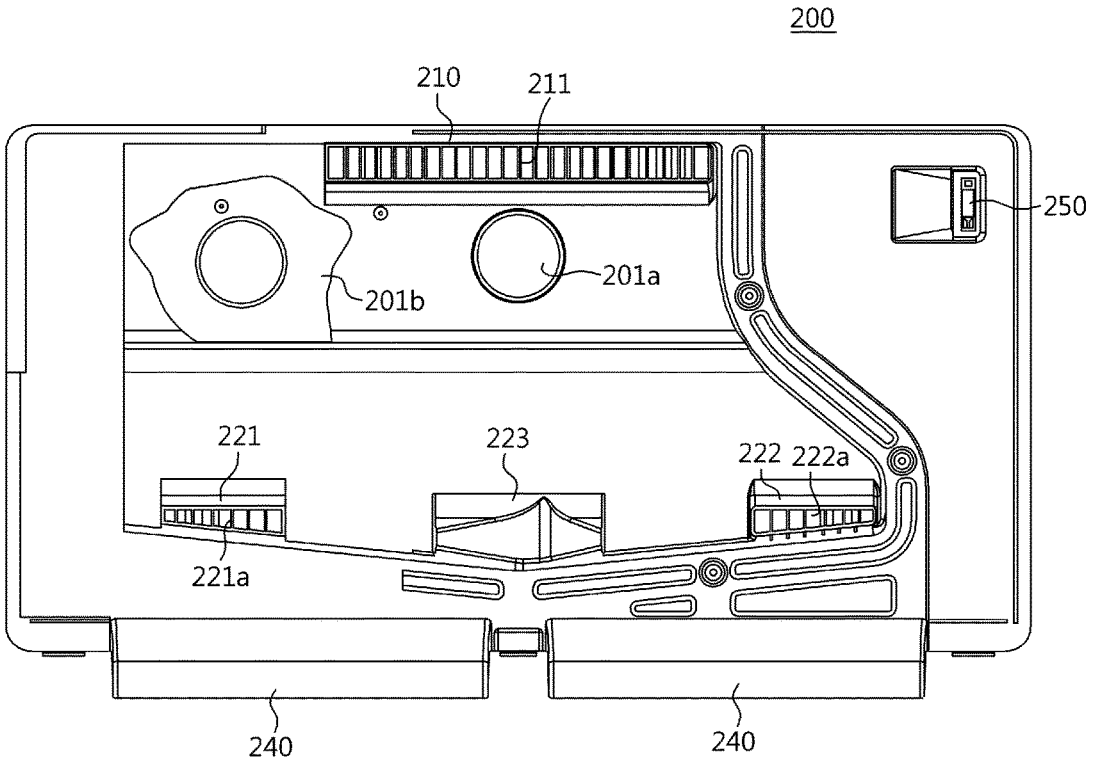
FIG. 14 is a front view illustrating the grill fan of the refrigerator according to the embodiment of the present disclosure.
Figure 15:
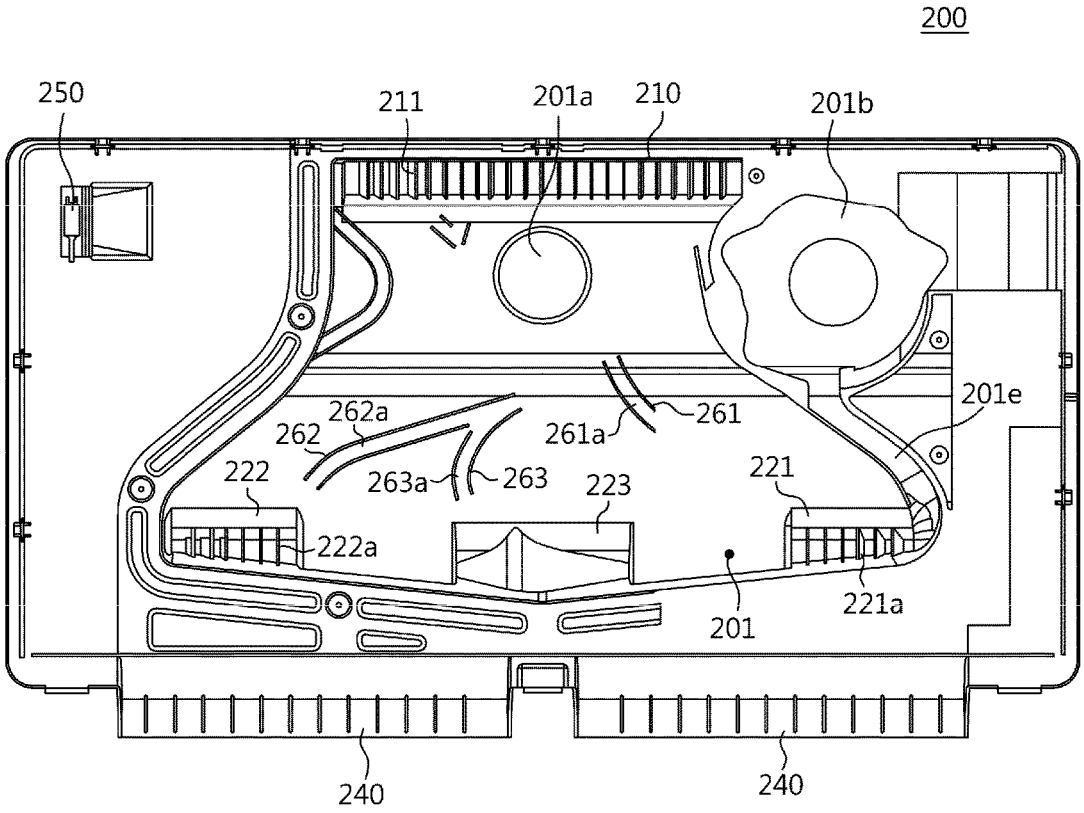
FIG. 15 is a rear view illustrating the grill fan of the refrigerator according to the embodiment of the present disclosure.
Figure 17:
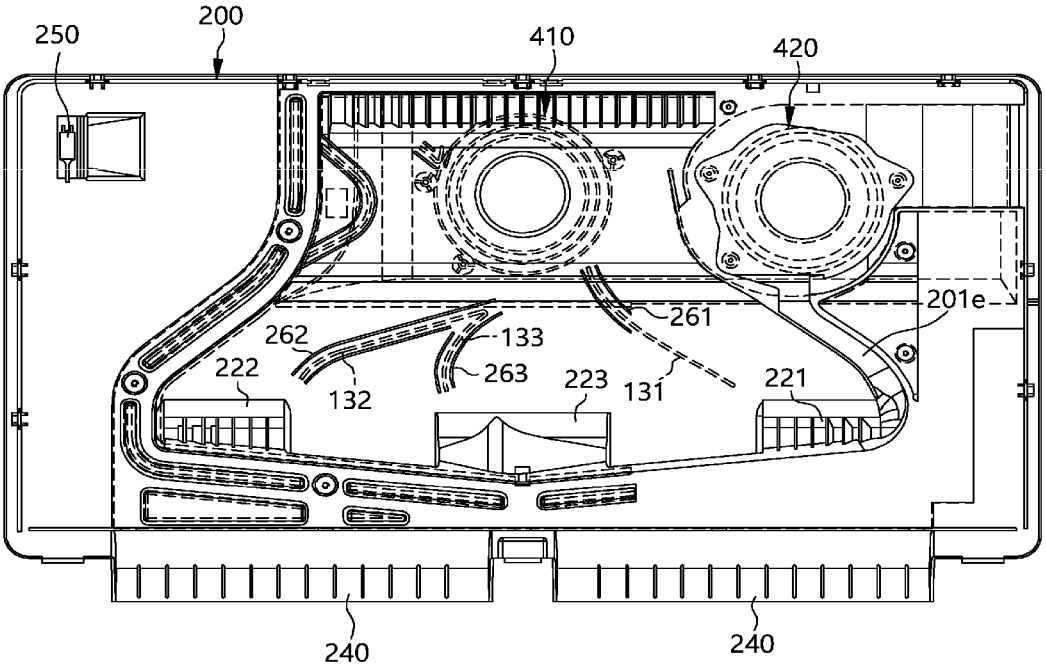
FIG. 17 is a rear view illustrating an example of a state in which each guide is received in a receiving rib when the shroud is coupled to the grill fan of the refrigerator according to the embodiment of the present disclosure.

FIG. 14 is a front view illustrating the grill fan of the refrigerator according to the embodiment of the present disclosure, FIG. 15 is a rear view illustrating the grill fan of the refrigerator according to the embodiment of the present disclosure, FIG. 16 is a rear view illustrating a state in which the shroud is coupled to the grill fan of the refrigerator according to the embodiment of the present disclosure, and FIG. 17 is a rear view illustrating an example of a state in which each guide is received in a receiving rib when the shroud is coupled to the grill fan of the refrigerator according to the embodiment of the present disclosure.

As illustrated in in these drawings, the grill fan 200 may be a part that defines a front wall of the freezing compartment-side grill fan assembly 1.

The grill fan 200 may be located in front of the shroud 100.

The grill fan 200 may include the cool air flow path 201 for the freezing compartment.

The cool air flow path 201 for the freezing compartment may be a flow path for guiding cool air introduced between the grill fan 200 and the shroud 100 through the first inlet hole 110 to be supplied to the freezing compartment 12.

The cool air flow path 201 for the freezing compartment may be formed by protruding (or depressing) the rear surface of the grill fan 200 forward.

In particular, a first seat 201*a* in which the freezing fan module 410 is located may be formed on the cool air flow path 201 for the freezing compartment at a position facing a position where the first inlet hole 110 of the shroud 100 is formed. In addition, a second seat 201*b* in which the ice making fan module 420 is located may be formed on the cool air flow path 201 for the freezing compartment at a position facing a position where the second inlet hole 120 is formed.

Each of the seats 201*a* and 201*b* may be formed as a recessed groove to allow a part of associated one of the fan modules 410 and 420 to be received therein.

The cool air flow path 201 for the freezing compartment may guide the flow of cool air from a first side (e.g., the left side when viewed with reference to FIG. 9) to a second side (e.g., the right side when viewed with reference to FIG. 9).

The grill fan 200 may include the main cool air outlet 210.

The main cool air outlet 210 may be an open part for supply of cool air to the freezing compartment 12 and may be formed at a portion of the grill fan 200 above the first seat 201*a*.

In particular, the main cool air outlet 210 may be configured as a grill body that protrudes forward. That is, the main cool air outlet 210 may impart linearity to cool air passing therethrough, so that the cool air passing through the main cool air outlet 210 may be directly discharged forward without being dispersed upward and downward and may be supplied to a front side (a rear wall of the freezing compartment door) of the freezing compartment 12.

In addition, the main cool air outlet 210 may be formed to extend across where an upper end of the freezing fan module 410 is located. That is, the main cool air outlet 210 may be located at a portion where cool air is blown by the freezing fan 411 so that the amount of cool air discharged through the main cool air outlet 210 may be increased.

A plurality of grill ribs 211 may be formed in the main cool air outlet 210.

The grill ribs 211 may be ribs that guide the discharge direction of cool air discharged through the main cool air outlet 210.

The grill ribs 211 may be arranged to be spaced apart from each other, and may be formed to be inclined forward or in opposite directions.

The grill fan 200 may include the auxiliary cool air outlets 221, 222, and 223.

These auxiliary cool air outlets 221, 222, and 223 may be holes for allowing supply of cool air to an intermediate space in the freezing compartment 12. That is, when considering that the main cool air outlet 210 may supply cool air only to an upper space in the freezing compartment 12, the supply of cool air to the intermediate space may be relatively insufficient compared to the upper space. Therefore, through the additional provision of the auxiliary cool air outlets 221, 222, and 223, sufficient cool air may be supplied to the intermediate space in the freezing compartment 12.

The auxiliary cool air outlets 221, 222, and 223 may be formed along a bottom surface of the cool air flow path 201 for the freezing compartment.

That is, cool air flowing along the cool air flow path 201 for the freezing compartment may be discharged to the freezing compartment 12 through each of the auxiliary cool air outlets 221, 222, and 223 while flowing along the bottom surface of the cool air flow path 201 for the freezing compartment.

These auxiliary cool air outlets 221, 222, and 223 may include the first auxiliary cool air outlet 221 formed on a first side (left side in FIG. 14 when viewed from the front of the grill fan) of the cool air flow path 201 for the freezing compartment, the second auxiliary cool air outlet 222 formed on a second side (right side in FIG. 14 when viewed from the front of the grill fan), and the third auxiliary cool air outlet 223 formed between the two auxiliary cool air outlets 221 and 222.

That is, cool air may flow along the cool air flow path 201 for the freezing compartment while sequentially passing through the first auxiliary cool air outlet 221, the third auxiliary cool air outlet 223, and the second auxiliary cool air outlet 222 so that the cool air may be additionally supplied to the freezing compartment 12.

The main cool air outlet 210 may be formed to be larger than a combined size of the auxiliary cool air outlets 221, 222, and 223 so that most of cool air blown by the freezing fan module 410 may be supplied into the freezing compartment 12 through the main cool air outlet 210.

In addition, among the auxiliary cool air outlets 221, 222, and 223, grill ribs 221*a* and 222*a* may be formed in the first auxiliary cool air outlet 221 and the second auxiliary cool air outlet 222.

Each of the grill ribs 221*a* and 222*a* may be a structure that imparts directionality to the cool air discharged through the auxiliary cool air outlets 221 and 222, and at least a part of the grill ribs 221*a* and 222*a* may be formed to be inclined so as to guide cool air passing through an associated one of the grill ribs 221*a* and 222*a* toward a side portion of the freezing compartment 12.

In addition, the first auxiliary cool air outlet 221 and the second auxiliary cool air outlet 222 may be configured as grill bodies that protrude forward.

That is, the two auxiliary cool air outlets 210 and 222 may impart linearity to cool air passing therethrough, so that the cool air passing through the auxiliary cool air outlets 210 and 222 may be directly discharged forward without being dispersed upward and downward and may be supplied to the front side of the freezing compartment 12.

The third auxiliary cool air outlet 223 may be configured to discharge cool air toward opposite side walls of the freezing compartment 12. That is, the third auxiliary cool air outlet 223 may be configured as a grill body with opposite sides open so that cool air guided into the third auxiliary cool air outlet 223 along the cool air flow path 201 for the freezing compartment may be discharged toward the opposite side walls of the freezing compartment 12.

In addition, a front surface of the third auxiliary cool air outlet 223 may be formed to be inclined toward opposite sides thereof so as to protrude forward with respect to a predetermined reference portion thereof (inclination starting point, see schematic view of FIG. 7). That is, by this inclined structure of the front surface, cool air guided into the third auxiliary cool air outlet 223 may efficiently flow toward the opposite sides thereof.

In particular, the third auxiliary cool air outlet 223 may be configured so that of cool air discharged through the opposite sides thereof, a part of the cool air discharged to a communication portion communicating with the recovery duct 52 for the ice making compartment may be larger in discharge amount than a remaining part of the cool air.

That is, cool air flowing through the ice making compartment 21 may be guided to one of opposite side walls of the freezing compartment 12 to be recovered through the recovery duct 52 for the ice making compartment, so that the cool air temperature on the side wall of the freezing compartment 12 may be in a relatively high temperature range compared to the cool air temperature on a remaining one of the opposite side walls of the freezing compartment 12.

Therefore, by allowing the inclination starting point of the third auxiliary cool air outlet 223 to be located biased closer the side wall (opposite to the side wall to which the recovery duct for the ice making compartment is connected) of the freezing compartment 12, more cool air may be supplied toward the side wall to which the recovery duct 52 for the ice making compartment is connected. Accordingly, an increase in temperature of a portion due to cool air recovered through the recovery duct 52 for the ice making compartment and temperature irregularity of each portion of the freezing compartment may be eliminated.

The grill fan 200 may include a suction guide 240 for guiding a recovery flow of cool air flowing through the freezing compartment 12. The suction guide 240 may be formed at a lower end of the grill fan 200 and may be configured to guide the flow of cool air recovered after circulating in the freezing compartment 12 into a lower end of the second evaporator 32.

The suction guide 240 may be formed to be inclined (or rounded) toward the lower end thereof at an angle equal to (or substantially equal) to a wall forming the rear portion of the freezing compartment 12. That is, cool air flowing along the bottom of the freezing compartment 12 may efficiently flow to the lower end of the second evaporator 32 under guidance of the suction guide 240.

The grill fan 200 may include a temperature sensor 250.

The temperature sensor 250 may be a sensor for sensing the temperature in the freezing compartment 120, and may be located at one of opposite end portions of the grill fan 200.

The grill fan 200 may include receiving guides 261, 262, and 263 formed on the rear surface thereof (see FIG. 15).

The receiving guides 261, 262, and 263 may be parts in which receiving grooves 261*a*, 262*a*, and 263*a* are formed so that the guides 131, 132, and 133 formed on the front surface of the shroud 100 may be received therein.

That is, since the guides 131, 132, and 133 may be received in the receiving grooves 261*a*, 262*a*, and 263*a*, respectively, leakage of cool air through a gap formed between the end surfaces of the guides 131, 132, and 133 and the rear surface of the grill fan 200 may be prevented.

Figure 18:
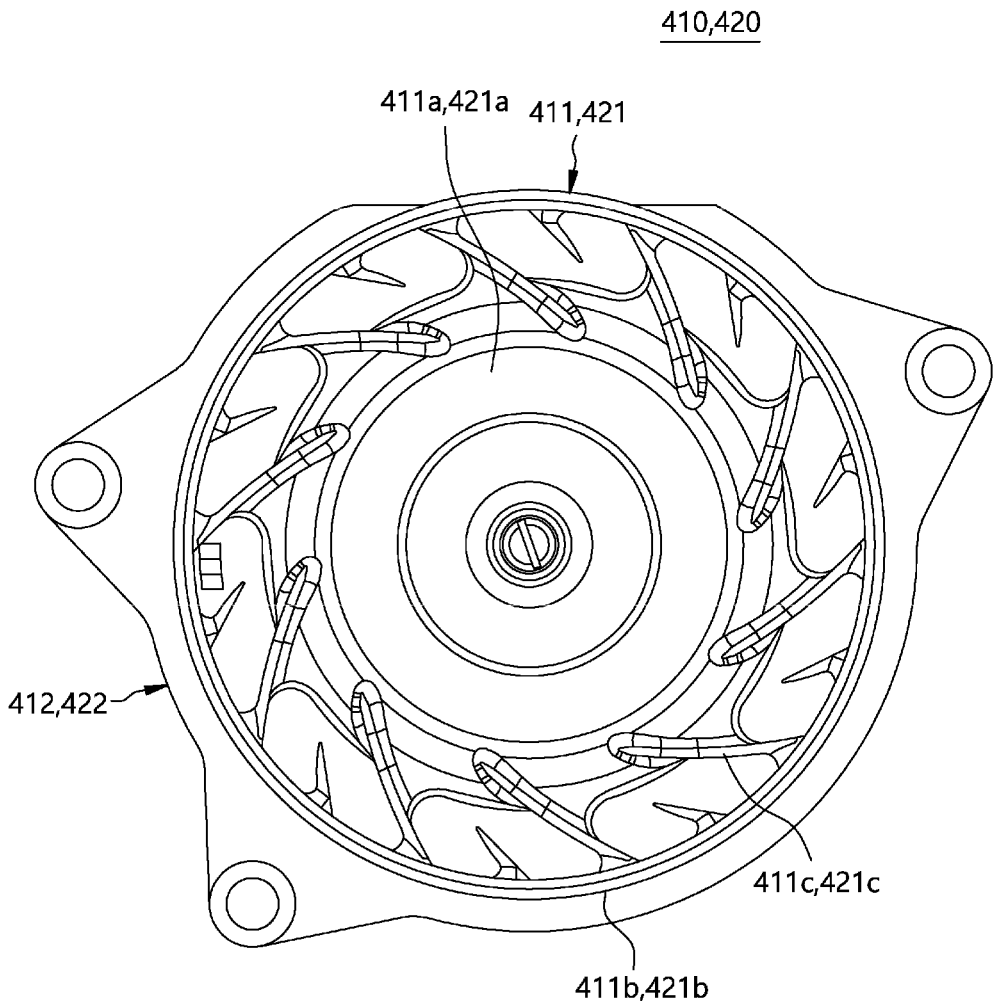
FIG. 18 is a front view illustrating a fan module of the refrigerator according to the embodiment of the present disclosure.
Figure 19:
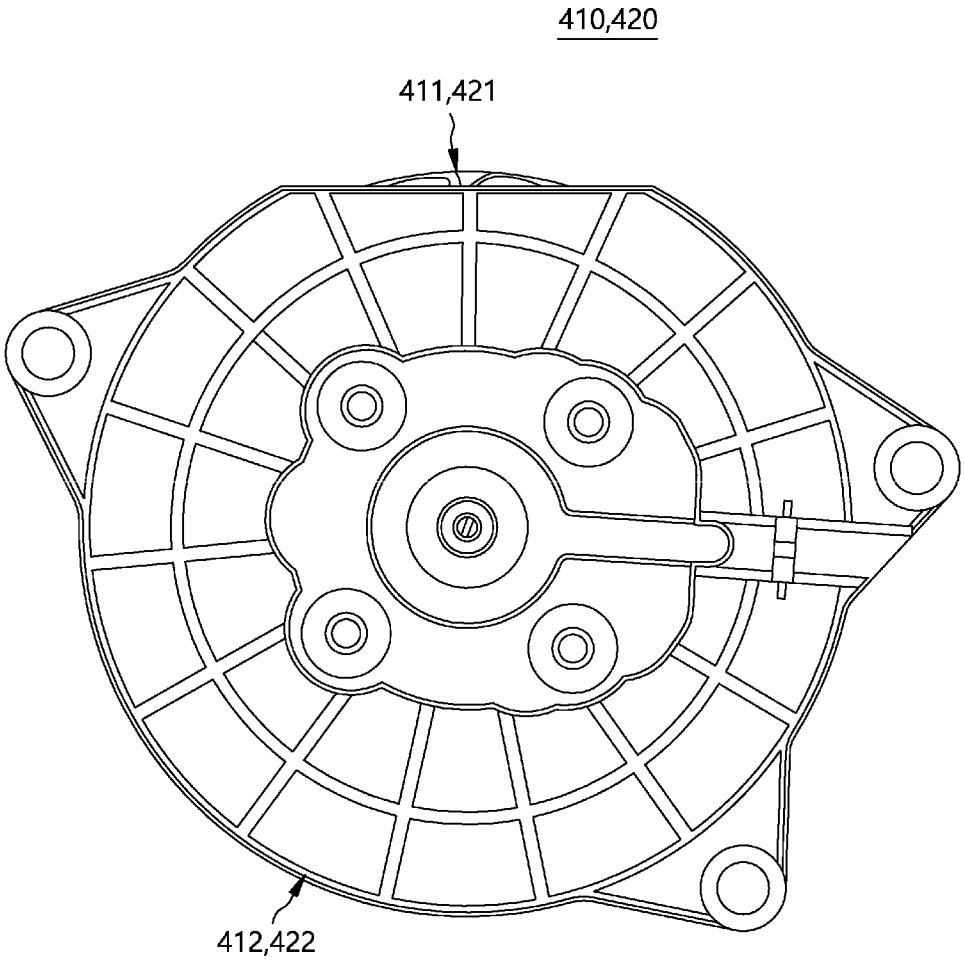
FIG. 19 is a rear view illustrating the fan module of the refrigerator according to the embodiment of the present disclosure.

Next, the freezing fan module 410 will be described with reference to FIGS. 18 and 19.

The freezing fan module 410 may be configured to blow cool air passing through the second evaporator 32 into the cool air flow path 201 for the freezing compartment.

The freezing fan module 410 may be seated in the second seat 201*b* of the grill fan 200 and may be located to face the first inlet hole 110 of the shroud 100.

The freezing fan module 410 may include the freezing fan 411 and a first installation frame 412.

The freezing fan 411 may be configured as a slim centrifugal fan, so that the thickness (width in the front and rear direction) of the freezing compartment-side grill fan assembly 1 may be reduced.

The freezing fan 411 may include a hub 411*a*, a rim 411*b*, and a plurality of impellers 411*c*.

The hub 411*a* may be a part that is shafted to a fan motor (not illustrated), and may protrude forward (in the direction toward the cool air introduction side) toward a central portion thereof, with a rear portion rapidly expanding toward the end thereof.

The rim 411*b* may be a part that is formed to surround the hub 411*a*. The rim 411*b* may be configured as a cylindrical rim.

The impellers 411*c* may be parts that are provided to guide the blowing direction of cool air. The impellers 411*c* may be configured so that the plurality of the impellers 411*c* may be arranged to be spaced apart from each other and inclined (or rounded) at respective predetermined angles to allow passage of cool air therebetween.

The first installation frame 412 may be a part where the freezing fan 411 is installed.

The first installation frame 412 may be configured to be coupled to a plurality of fastening ribs 412*a*, 412*b*, and 412*c* formed on the shroud 100. The fastening ribs 412*a*, 412*b*, and 412*c* may be formed at respective positions determined in consideration of the size and wind direction of the freezing fan 411.

Next, the ice making fan module 420 will be described with reference to FIGS. 18 and 19.

The ice making fan module 420 may be configured to blow cool air passing through the second evaporator 32 into the cool air flow path 101 for the ice making compartment.

The ice making fan module 420 may include a blowing fan (hereinafter, referred to as "ice making fan") 421 and a second installation frame 422.

The ice making fan 421 may be configured as a slim centrifugal fan, so that the thickness (width in the front and rear direction) of the freezing compartment-side grill fan assembly 1 may be reduced.

The ice making fan 421 may include a hub 421*a*, a rim 421*b*, and a plurality of impellers 421*c*.

The hub 421*a* may be a part that is shafted to a fan motor (not illustrated), and may protrude forward (in the direction toward the cool air introduction side) toward a central portion thereof, with a rear portion rapidly expanding toward the end thereof.

The rim 421*b* may be a part that is formed to surround the hub 421*a*. The rim 421*b* may be configured as a cylindrical rim.

The impellers 421*c* may be parts that are provided to guide the blowing direction of cool air. The impellers 421*c* may be configured so that the plurality of the impellers 411*c* may be arranged to be spaced apart from each other and inclined (or rounded) at respective predetermined angles to allow passage of cool air therebetween.

In particular, the ice making fan 421 may be provided as a fan having the same structure and size as the freezing fan 411 of the freezing fan module 410.

That is, the ice making fan 421 and the freezing fan 411 (or, the ice making fan module and the freezing fan module) may be commonized, so that standardization of product design due to the common use of the fan module may be achieved.

The second installation frame 422 may be a part where the ice making fan 421 is installed.

The second installation frame 422 may be configured to be coupled to a plurality of fastening ribs 422*a*, 422*b*, and 422*c* formed on the shroud 100. The fastening ribs 422*a*, 422*b*, and 422*c* may be formed at respective positions determined in consideration of the size and wind direction of the ice making fan 421.

Meanwhile, the ice making fan module 420 may be configured to be located closer to the freezing fan module 410 (see FIG. 9) than the cool air discharge side of the cool air flow path 101 for the ice making compartment. That is, the ice making fan 421 of the ice making fan module 420 may be located to be spaced apart a sufficient distance from the cool air discharge side (open portion) of the cool air flow path 101 for the ice making compartment, so that a phenomenon, in which cool air passing through the cool air discharge side of the cool air flow path 101 for the making compartment cannot pass efficiently through the cool air discharge side due to a resistance against the flow of cool air rotated in the rotational direction of the ice making fan 421 and becomes turbulent, may be prevented.

In addition, the ice making fan 421 constituting the ice making fan module 420 may be configured to rotate at a higher rotational speed than the freezing fan 411 constituting the freezing fan module 410.

That is, the freezing fan 411 may be rotated at a rotational speed sufficient to provide a high air volume because the freezing fan 411 may provide cool air to the freezing compartment 12 in front thereof, whereas the ice making compartment 21 may be rotated at a higher rotational speed than the freezing fan 411 to supply cool air to the ice making compartment 21 because the ice making compartment 21 is located relatively farther away than the freezing compartment 12.

In addition, the center of the ice making fan module 420 may be located at a position lower than the center of the cool air discharge-side open portion of the cool air flow path 101 for the ice making compartment.

That is, when considering that cool air discharged upward with respect to the center of the ice making fan 421 may be guided to be supplied to the ice making compartment 21 through the cool air flow path 101 for the ice making compartment, the center of the ice making fan 421 may be located lower than the center on the cool air discharge side (e.g., the bottom surface on the cool air discharge side) of the cool air flow path 101 for the ice making compartment so that the cool air blown from the ice making fan 421 may efficiently flow along the cool air flow path 101 for the ice making compartment.

Meanwhile, a cool air introduction-side portion (a peripheral portion of the first inlet hole) of the cool air flow path 101 for the ice making compartment may be divided into a plurality of areas 102*a*, 102*b*, and 102*c* for introduction of cool (see FIG. 10).

That is, the cool air flow path 101 for the ice making compartment may include: the first area 102*a* commonly located between the first circumferential flow path rib 101*a*, the second circumferential flow path rib 101*b*, and the ice making fan module 420; the second area 102*b* located between a bottom surface of the ice making fan module 420 and the second circumferential flow path rib 101*b*; and the third area 102*c* located between a top surface of the ice making fan module 420 and the first circumferential flow path 101*a* and communicating with the cool air discharge side of the cool air flow path 101 for the ice making compartment.

The respective areas 102*a*, 102*b*, and 102*c* may be separated by the respective fastening ribs 422*a*, 422*b*, and 422*c* of the ice making fan module 420.

That is, the fastening ribs 422*a*, 422*b*, and 422*c* may include a first fastening rib 422*a* located neighboring to the first circumferential flow path rib 101*a*, a second fastening rib 422*b* located neighboring to the second circumferential flow path rib 101*b*, and a third fastening rib 422*c* located neighboring to the straight flow path rib 101*c*.

In particular, with respect to the position of the ice making fan module 420, the first area 102*a* may be an area between the first fastening rib 422*a* and the second fastening rib 422*b* on the circumferential side of the ice making fan module 420, the second area 102*b* may be an area between the second fastening rib 422*b* and the third fastening rib 422*c* on the circumferential side of the ice making fan module 420, and the third area 102*c* may be an area between the first fastening rib 422*a* and the third fastening rib 422*c* on the circumferential side of the ice making fan module 420.

The first area 102*a* may communicate with the shared flow path 101*d*, the second area 102*b* may communicate with the supply flow path 201*e* (see FIGS. 15 and 17), and the third are 102*c* may communicate with the cool air discharge side of the cool air flow path 101 for the ice making compartment. The supply flow path 201*e* may be a flow path for guiding the supply of cool air toward the bottom surface of the cool air flow path 201 for the freezing compartment, and may serve to resolve the difference in pressure between the first inlet hole 110 and the second inlet hole 120 by supplying cool air to the freezing compartment 12 when the ice making fan 421 is operated solely.

The third area 102*c* may allow the supply of cool air in an amount substantially equal to a combined size of the first area 102*a* and the second area 102*b*, and the second area 102*b* may allow the supply of cool air in a relatively large amount compared to the first area 102*a*. That is, about half of the entire cool air blown by the operation of the ice making fan 421 may be supplied to the ice making compartment 21 through the third area 102*c*, and the remaining half may be supplied to the cool air flow path 201 for the freezing compartment through the first area 102*a* and the second area 102*b*.

The cool air supplied to the first area 102*a* may be discharged toward a top surface of the cool air flow path 201 for the freezing compartment through the shared flow path 101*d*, and the cool air supplied to the second area 102*b* may be discharged toward the bottom surface of the cool air flow path 201 for the freezing compartment through the supply flow path 201*e*.

Through the differentiation of the supply amount of cool air for each portion, sufficient cool air may also be supplied to the freezing compartment 12 while cool air may be supplied to the ice making compartment 21.

Hereinbelow, a temperature control process of each of the freezing compartment 12 and the ice making compartment 21 by the operation of the freezing compartment-side grill fan assembly 1 according to the embodiment of the present disclosure described above will be described in more detail.

First, a process for controlling the temperature of the freezing compartment 12 will be described with reference to FIGS. 20 to 22.

Figure 20:
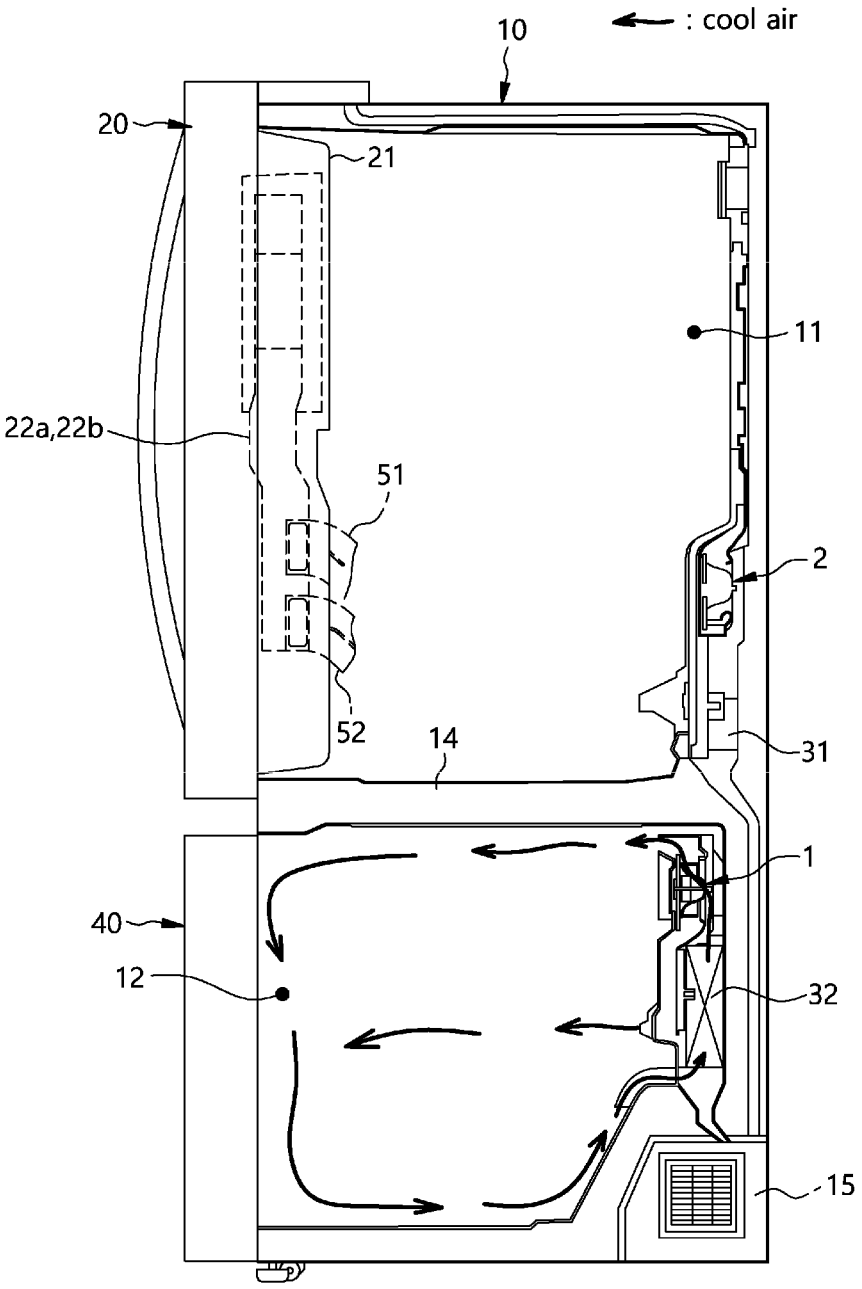
FIG. 20 is a side sectional view illustrating the flow of cool air during a freezing operation for a freezing compartment of the refrigerator according to the embodiment of the present disclosure.
Figure 21:
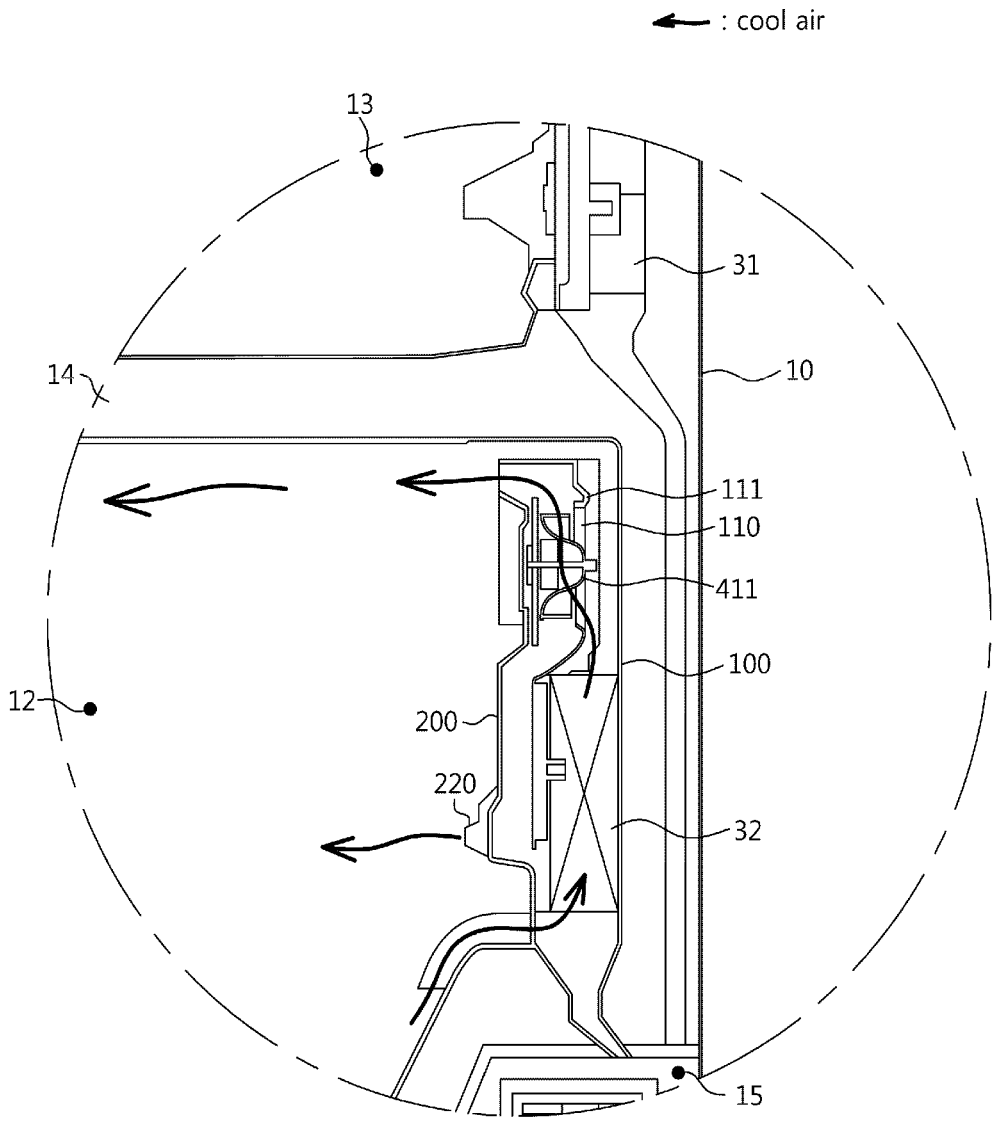
FIG. 21 is an enlarged view of main parts illustrating the flow of cool air by the freezing compartment-side grill fan assembly illustrated in FIG. 20.
Figure 22:
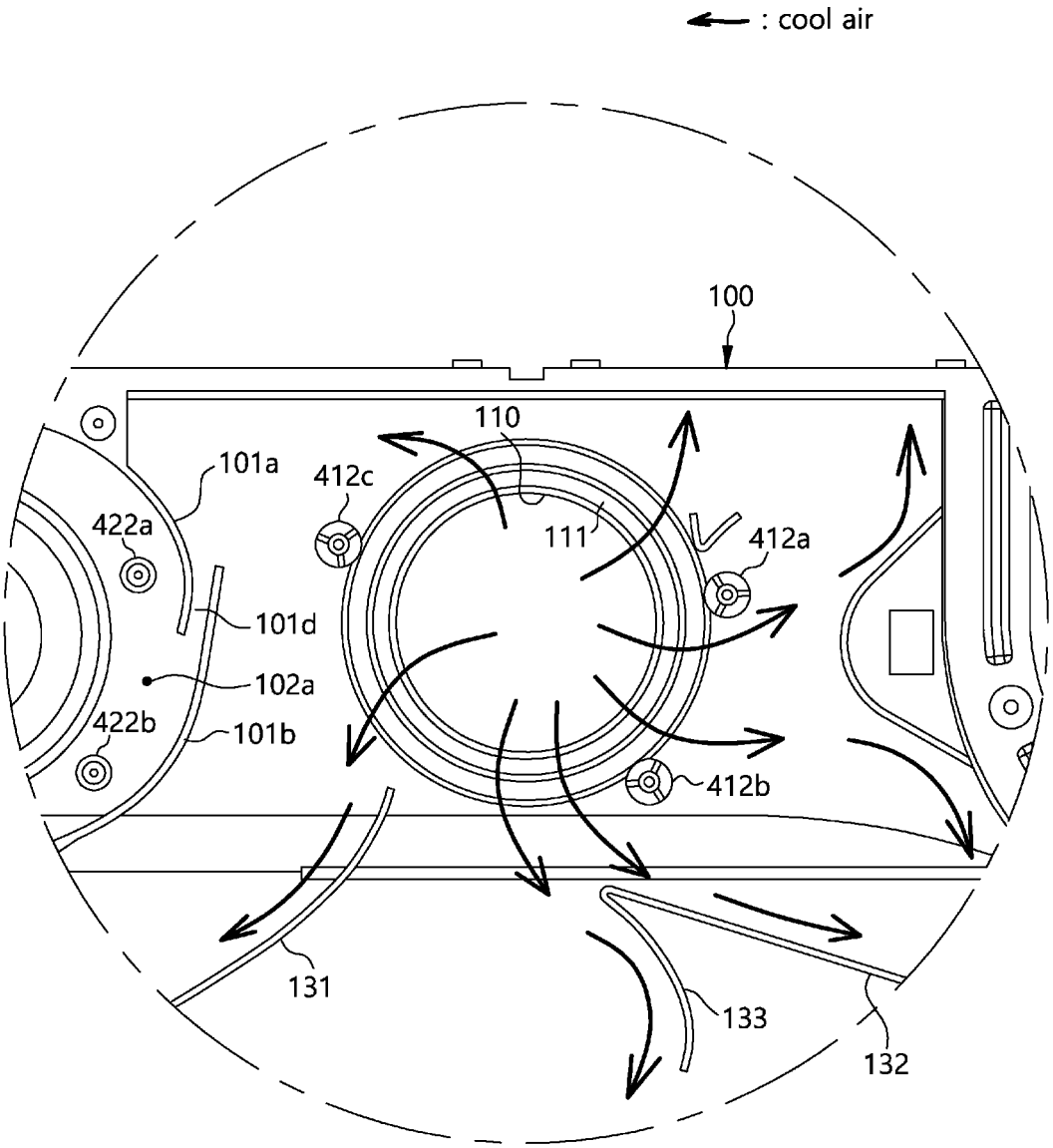
FIG. 22 is a state view illustrating the flow of cool air during the freezing operation for the freezing compartment of the refrigerator according to the embodiment of the present disclosure, when viewed from the rear of the grill fan.

FIG. 20 is a side sectional view illustrating the flow of cool air during a freezing operation for a freezing compartment of the refrigerator according to the embodiment of the present disclosure, FIG. 21 is an enlarged view of main parts illustrating the flow of cool air by the freezing compartment-side grill fan assembly illustrated in FIG. 20, and FIG. 22 is a state view illustrating the flow of cool air during the freezing operation for the freezing compartment of the refrigerator according to the embodiment of the present disclosure, when viewed from the rear of the grill fan.

As illustrated in these drawings, temperature control for the freezing compartment 12 may be performed by the operation of the freezing fan module 410 and a compressor (not illustrated). That is, the operation for temperature control for the freezing compartment 12 may be performed by rotation of the freezing fan 411 by application of power to the freezing fan module 410, and by a heat exchange operation of the second evaporator 32 by the operation of the compressor.

As the freezing fan 411 of the freezing fan module 410 is operated, air existing in the freezing compartment 12 may be forced to flow through the second evaporator 32 by means of a blowing force of the freezing fan 411 and may undergo heat exchange while passing through the second evaporator 32.

The heat-exchanged air (cool air) may flow into the cool air flow path 201 for the freezing compartment through the first inlet hole 110 of the shroud 100 and then flow along the cool air flow path 201 for the freezing compartment. The cool air flowing along the cool air flow path 201 for the freezing compartment may be supplied to the upper space in the freezing compartment 12 through the main cool air outlet 210 formed in the grill fan 200.

Of the cool air flowing by means of the blowing force of the freezing fan 411, cool air that has not yet been discharged through the main cool air outlet 210 may continue to flow along the cool air flow path 201 for the freezing compartment. While passing the cool air flow path 201 for the freezing compartment, the cool air may be supplied to the intermediate space of the freezing compartment 12 sequentially through the first auxiliary cool air outlet 221, the third auxiliary cool air outlet 223, and the second auxiliary cool air outlet 222 formed in the cool air flow path 201 for the freezing compartment.

About half or more of the cool air that has passed through the first inlet hole 110 may be discharged to the upper space in the freezing compartment 12 through the main cool air outlet 210, and the remaining cool air may be discharged to the intermediate space in the freezing compartment 12 through the first auxiliary cool air outlet 221, the third auxiliary cool air outlet 223, and the second auxiliary cool air outlet 222.

In particular, the third auxiliary cool air outlet 223 may guide the cool air to be supplied to the opposite side walls of the freezing compartment 12.

Cool air that has not yet been discharged to the intermediate space in the freezing compartment 12 through the auxiliary cool air outlets 221, 222, and 223 may be circulated back to a position where the main cool air outlet 210 is located.

While the cool air passes through the respective auxiliary cool air outlets 221, 222, and 223 and is supplied to the freezing compartment 12, the discharge direction of the cool air may be guided by the respective grill ribs 221*a*, and 222*a* formed in the auxiliary cool air outlets 221, 222, and 223. That is, the cool air may be uniformly discharged to all areas of the freezing compartment 12 by the grill ribs 221*a* and 222*a*.

In particular, since the bottom surface of the cool air flow path 201 for the freezing compartment may be formed to be round, the cool air passing through the first auxiliary cool air outlet 221 may efficiently flow to the third auxiliary cool air flow path 223 and the second auxiliary cool air flow path 222 while flowing along the bottom surface of the cool air flow path 201 for the freezing compartment.

Therefore, the cool air may be uniformly supplied to the upper space, the intermediate space, and the opposite spaces in the freezing compartment 12.

The cool air supplied into the freezing compartment 12 through the respective cool air outlets 210, 221, 222, and 223 may flow through the freezing compartment 12 and may then be recovered to the air introduction side of the second evaporator 32 under guidance of the suction guide 240 formed on the grill fan 200.

In particular, when considering that the suction guide 240 may be formed to be inclined (or rounded), the cool air flowing along an inclined wall of a machine room 15 after flowing through the freezing compartment 12 may efficiently flow to the air introduction side of the second evaporator 101 under guidance of the suction guide 240. This is as illustrated in the FIG. 20.

During a freezing operation of supplying cool air to the freezing compartment 12, the temperature in the freezing compartment 12 may be continuously checked by the temperature sensor 250 installed at the grill fan 200, and when it is determined that the temperature in the freezing compartment 12 is lower than a predetermined temperature (when a predetermined temperature condition is satisfied), the operation of the freezing fan 411 and a freezing cycle may be stopped to stop the supply of cool air.

When the temperature in the freezing compartment 12 is higher than the predetermined temperature, the freezing fan 411 and the freezing cycle may be operated again to supply cool air into the freezing compartment 12.

Therefore, the temperature in the freezing compartment 12 may be controlled by such repetitive circulation of air (cool air).

Meanwhile, during the temperature control for the freezing compartment 12, the ice making fan 421 may also be operated.

That is, in the case of an ice making operation, when considering that the ice making fan may be set to always operate except for special conditions (e.g., when the ice making compartment is full of ice), the ice making operation may be continuously performed during the freezing operation.

If the ice making operation is also performed during the freezing operation, the flow of cool air sequentially passing through the second inlet hole 120 and the cool air flow path 101 for the ice making compartment may be generated by the operation of the ice making fan 421.

A part of the cool air generated by the operation of the ice making fan 421 may be supplied to the cool air flow path 201 for the freezing compartment through the shared flow path 101*d*, and the remaining half of the cool air may be supplied to the ice making compartment 21 through the cool air duct 51 for the ice making compartment connected to the cool air flow path 101 for the ice making compartment.

That is, cool air blown into the first area 102*a* of the cool air flow path 101 for the ice making compartment through the second inlet hole 120 may be supplied to the cool air flow path 201 for the freezing compartment through the shared flow path 101*d*, cool air blown into the second area 102*b* of the cool air flow path 101 for the ice making compartment through the second inlet hole 120 may be supplied to the cool air flow path 201 for the freezing compartment through the supply flow path 201*e*, and cool air blown into the third area 102*c* of the cool air flow path 101 for the ice making compartment through the second inlet hole 120 may by supplied to the ice making compartment 21 through the cool air duct 51 for the ice making compartment connected to the cool air flow path 101 for the ice making compartment.

Therefore, sufficient cool air may be supplied into the freezing compartment 12 because not only cool air blown by the operation of the freezing fan 411 but also a part of cool air blown by the operation of the ice making fan 421 may be supplied.

In particular, cool air flowing through the ice making compartment 21 may be recovered to the freezing compartment 12 through the recovery duct 52 for the ice making compartment.

The cool air recovered to the freezing compartment 12 through the recovery duct 52 for the ice making compartment may have a higher temperature than cool air existing in the freezing compartment 12. Accordingly, in the freezing compartment 12, there may occur a phenomenon in which there is a difference in cool air temperature between the side wall to which the recovery duct 52 for the ice making compartment is connected and the opposite side wall.

However, cool air supplied to the freezing compartment 12 through the third auxiliary cool air outlet 223 while flowing along the cool air flow path 201 for the freezing compartment may be supplied to the freezing compartment 12 under guidance of the inclined front surface of the third auxiliary cool air outlet 223, and in particular, when considering that the third auxiliary air outlet 223 may be configured to supply more cool air toward the side wall of the freezing compartment 12 to which the recovery duct 52 for the ice making compartment is connected, the difference in temperature between the opposite side walls of the freezing compartment 12 may be reduced.

Accordingly, temperature control for the freezing compartment 12 may be performed more accurately.

Figure 23:
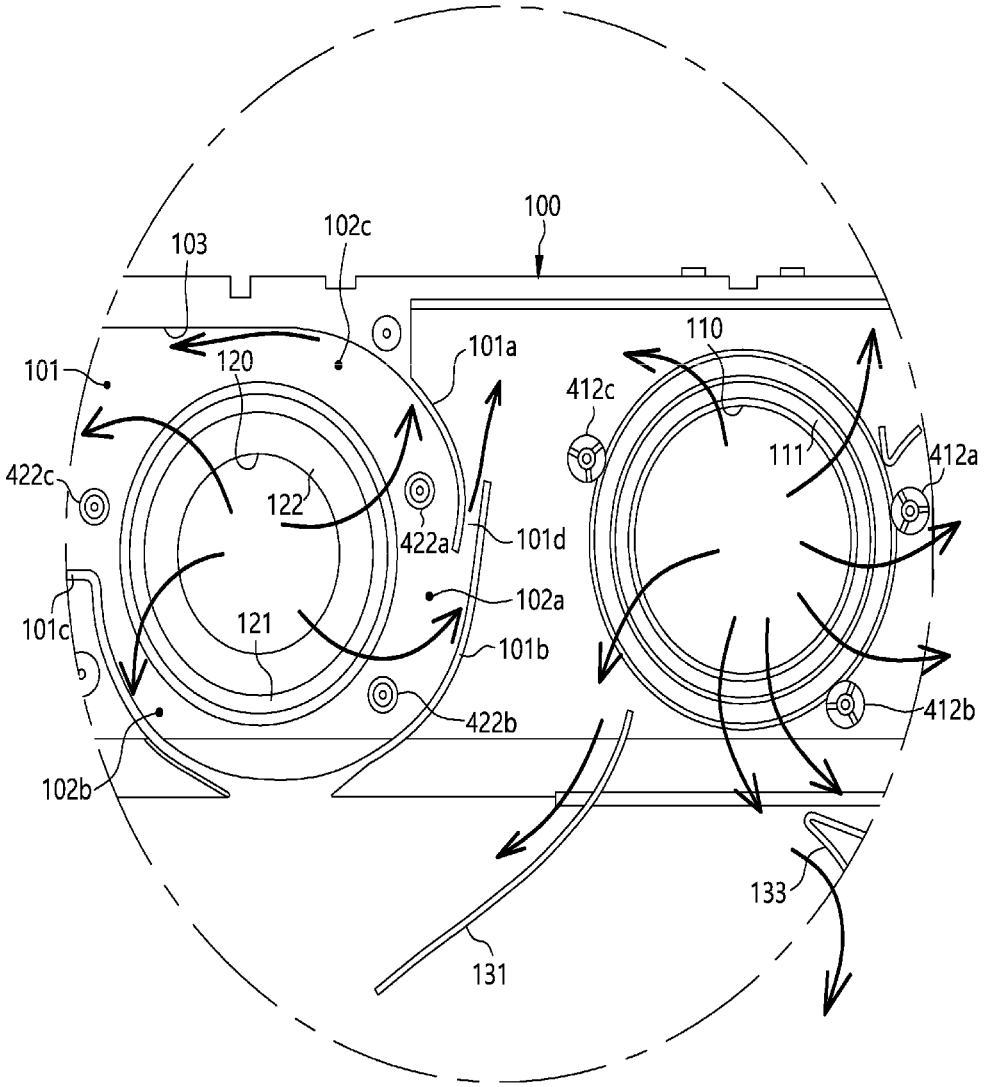
FIG. 23 is a state view illustrating the flow of cool air when freezing and ice making operations of the refrigerator according to embodiment of the present disclosure are simultaneously performed, when viewed from the rear of the grill fan.

The flow of cool air when the freezing operation and the ice making operation are simultaneously performed may be as illustrated in FIG. 23.

Next, an operation (ice making operation) for controlling the temperature of the ice making compartment 21 will be described with reference to FIGS. 24 to 27.

Figure 24:
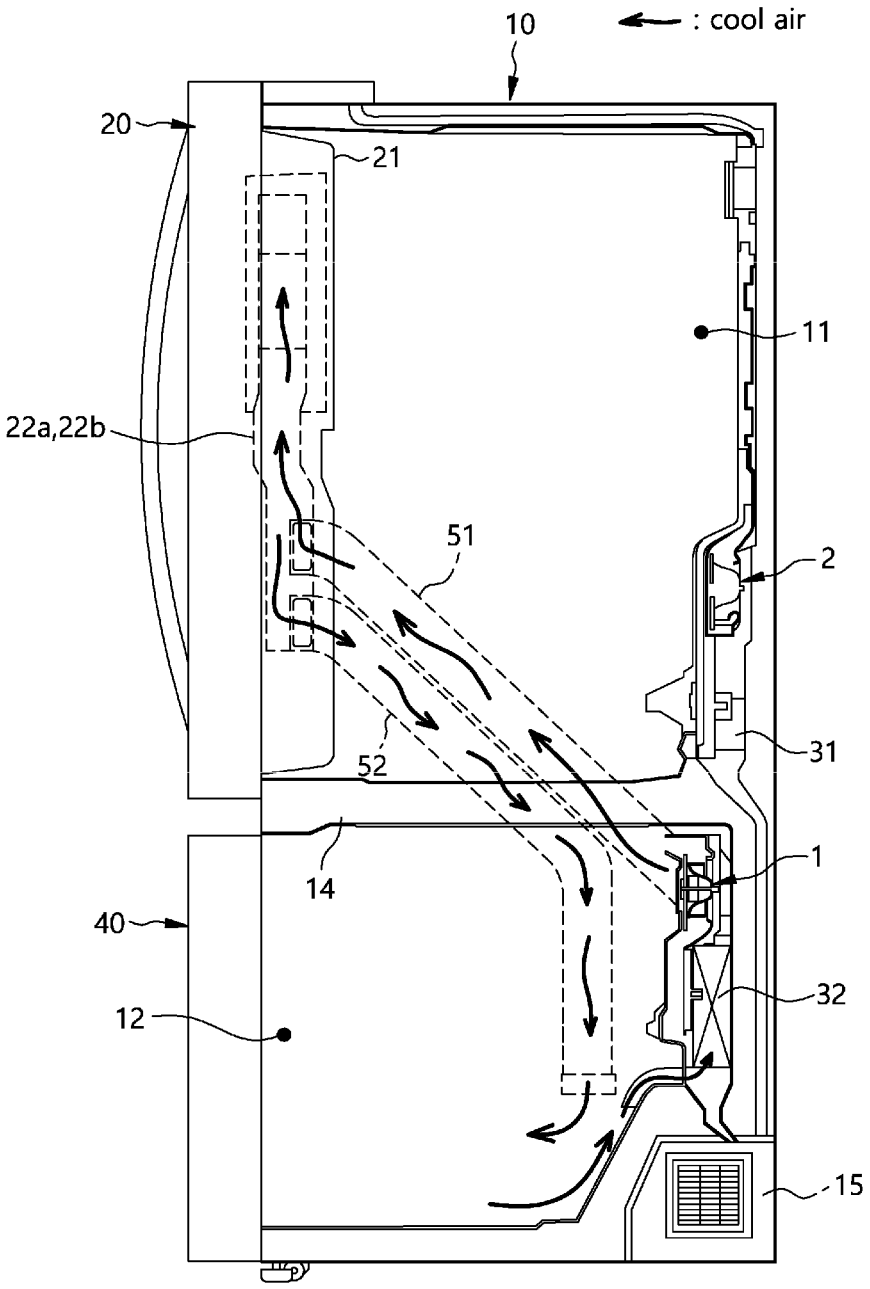
FIG. 24 is a side sectional view illustrating the flow of cool air during an ice making operation for an ice making compartment of the refrigerator according to embodiment of the present disclosure.
Figure 25:
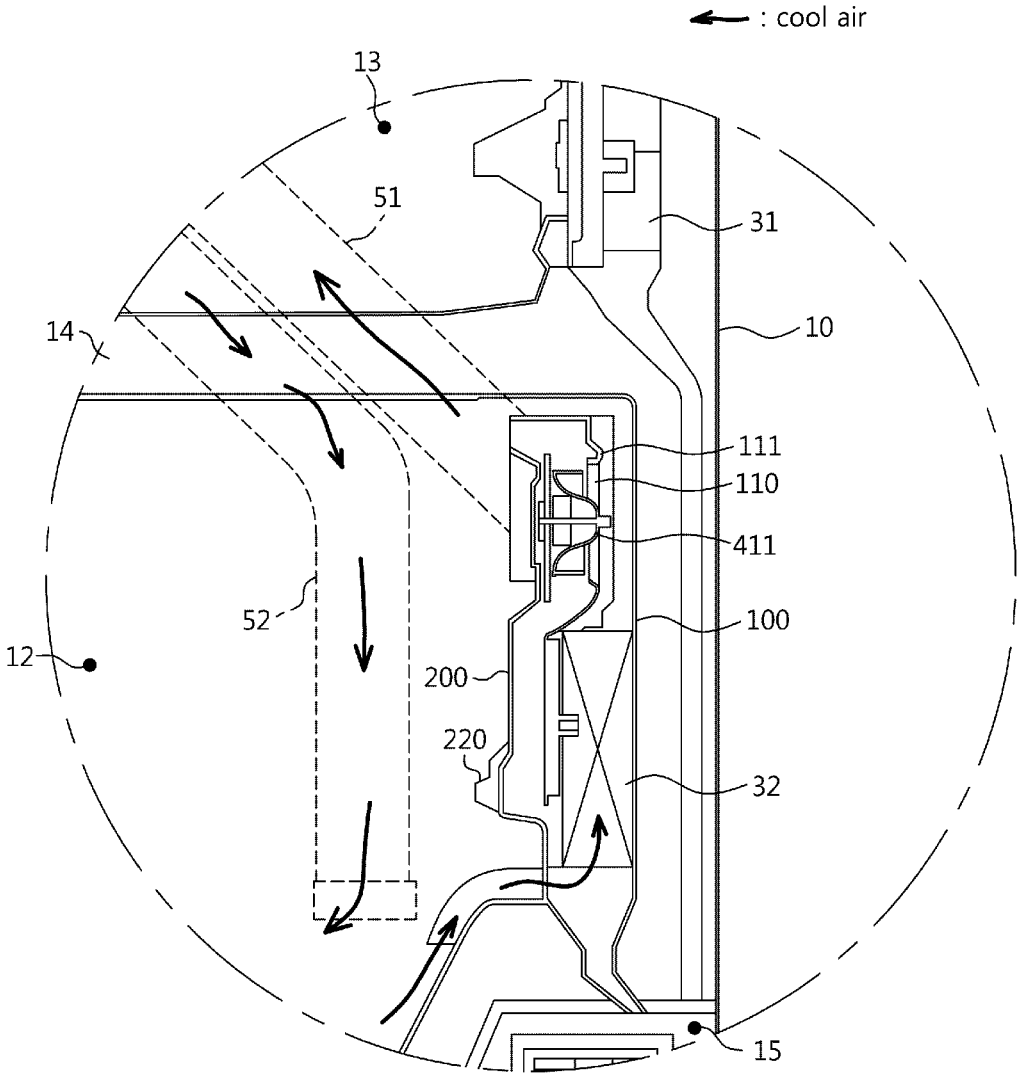
FIG. 25 is an enlarged view of main parts illustrating the flow of cool air by the freezing compartment-side grill fan assembly illustrated in FIG. 24.
Figure 26:
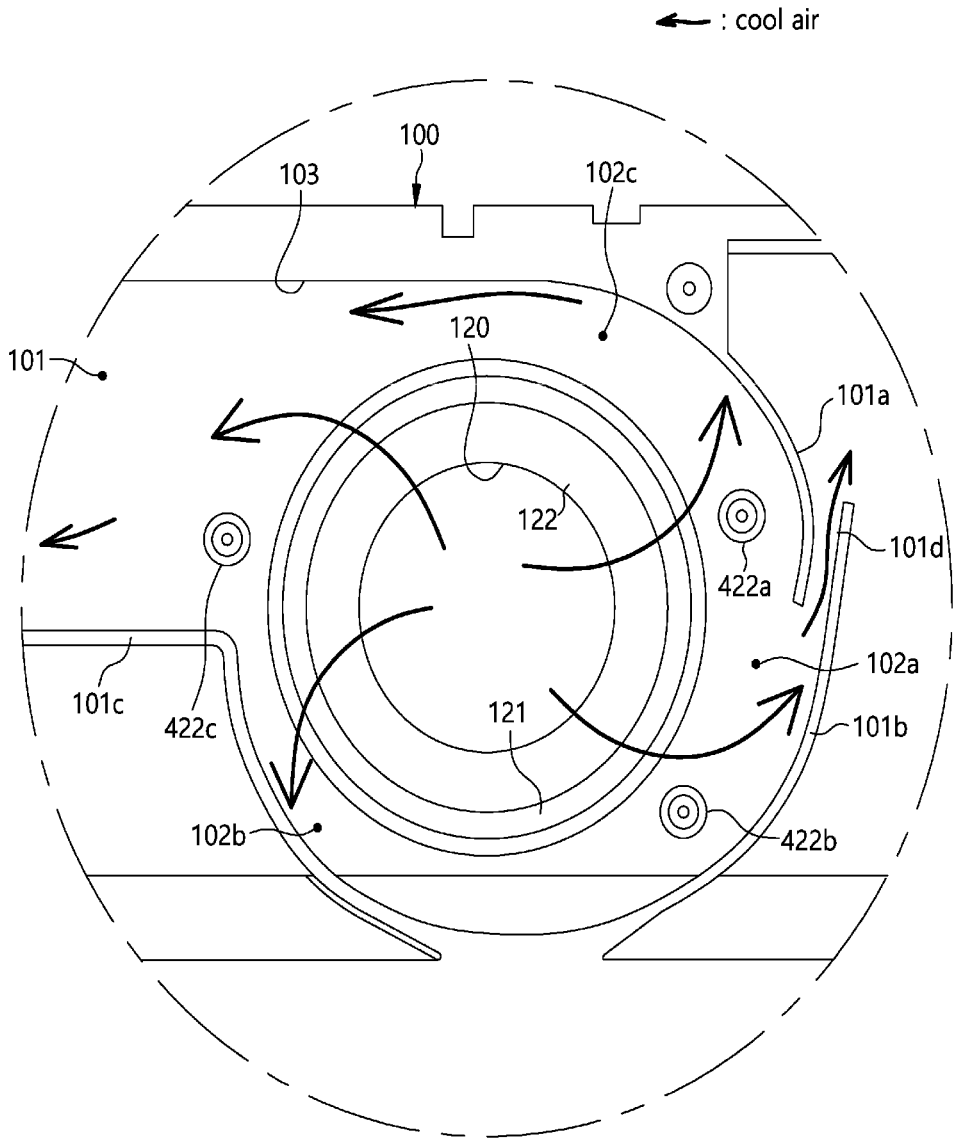
FIG. 26 is a state view illustrating the flow of cool air during the ice making operation for the ice making compartment of the refrigerator according to the embodiment of the present disclosure, when viewed from the rear of the grill fan.
Figure 27:
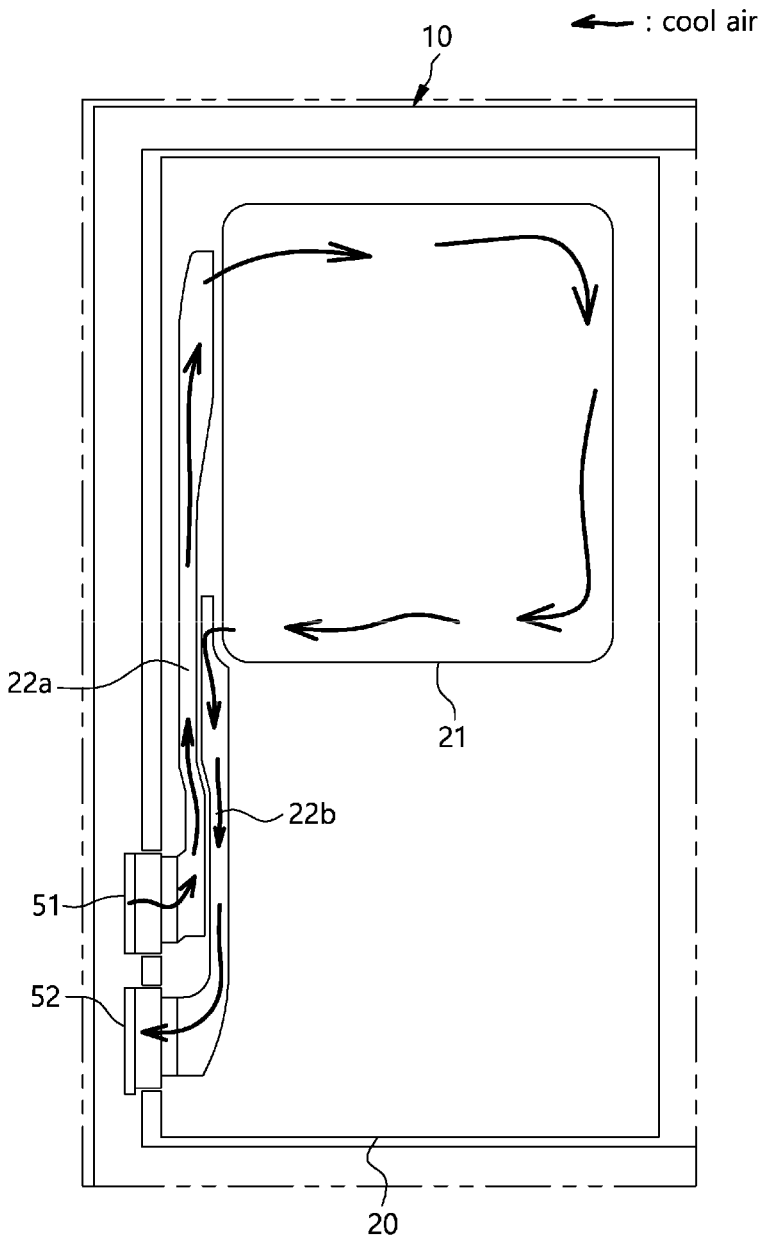
FIG. 27 is a state view illustrating the flow of supply and collection of cool air to the ice making compartment during the ice making operation for the ice making compartment of the refrigerator according to the embodiment of the present disclosure.

FIG. 24 is a side sectional view illustrating the flow of cool air during an ice making operation for an ice making compartment of the refrigerator according to embodiment of the present disclosure, FIG. 25 is an enlarged view of main parts illustrating the flow of cool air by the freezing compartment-side grill fan assembly illustrated in FIG. 24, FIG. 26 is a state view illustrating the flow of cool air during the ice making operation for the ice making compartment of the refrigerator according to the embodiment of the present disclosure, when viewed from the rear of the grill fan, and FIG. 27 is a state view illustrating the flow of supply and collection of cool air to the ice making compartment during the ice making operation for the ice making compartment of the refrigerator according to the embodiment of the present disclosure.

As illustrated in these drawings, temperature control for the ice making compartment 21 may be performed by the operation of the ice making fan 421 by application of power to the ice making fan module 420. The compressor may be operated or stopped depending on operating conditions of the freezing compartment 12.

As the ice making fan 421 is operated, air existing in the freezing compartment 12 may be forced to pass through the second evaporator 32 by means of the blowing force of the ice making fan 421 and may then flow into the first area 102*a*, the second area 102*b*, and the third area 102*c* of the cool air flow path 101 for the ice making compartment through the second inlet hole 120 of the shroud 100. The air may flow through the respective areas 102*a*, 102*b*, and 102*c* and may then be discharged from the cool air flow path 101 for the ice making compartment through communication portions with the respective areas 102*a*, 102*b*, and 102*c*.

Cool air flowing into the first area 102*a* may be supplied to the top surface of the cool air flow path 201 for the freezing compartment, cool air flowing into the second area 102*b* may be supplied to the bottom surface of the cool air flow path 201 for the freezing compartment through the supply flow path 201*e*, and cool air flowing into the third area 102*c* may be supplied to the ice making compartment 21 through the cool air duct 51 for the ice making compartment.

In addition, cool air supplied to the cool air flow path 201 for the freezing compartment through the shared flow path 101*d* may be blown toward the main cool air outlet 210 in the cool air flow path 201 for the freezing compartment and may be supplied to the freezing compartment 12 through the main cool air outlet 210, and cool air supplied to the cool air flow path 201 for the freezing compartment through the supply flow path 201*e* may flow along the bottom surface of the cool air flow path 201 for the freezing compartment and may be supplied to the freezing compartment 12 through the first auxiliary cool air outlet 221, the third auxiliary cool air outlet 223, and the second auxiliary cool air outlet 222.

In particular, of cool air supplied into the cool air flow path 101 for the ice making compartment by means of the blowing force of the ice making fan 421 through the second inlet hole 120, cool air discharged to the third area 102*c*, which is located corresponding to a top portion of the ice making fan 421, may flow toward the cool air discharge side of the cool air flow path 101 for the ice making compartment. Since the cool air may flow along a sufficient distance from the third area 102*c* to the cool air discharge side, the flow resistance generated when the distance between the third area 102*c* and the cool air discharge side is short may be reduced.

Therefore, the interior of the freezing compartment 12 may maintain a pressure substantially similar to that in the ice making compartment 21 by cool air supplied from the cool air flow path 101 for the ice making compartment through the shared flow path 101*d* and the supply flow path 201*e*. That is, the pressures of the freezing compartment 12 and the ice making compartment 21 may be substantially balanced. Therefore, even if only the ice making fan 421 is operated for the ice making operation, cool air of the freezing compartment 12 may be prevented (or minimized) from flowing into the second inlet hole 120 and the cool air flow path 101 for the ice making compartment by passing through the cool air flow path 201 and for the freezing compartment and the first inlet hole 110 in the reverse direction.

In addition, since the cool air outlet side of the supply flow path 201*e* may be configured to supply cool air toward an end of the bottom surface of the cool air flow path 201 for the freezing compartment, the cool air supplied into the cool air flow path 201 for the freezing compartment through the supply flow path 201*e* may flow along the bottom surface of the cool air flow path 201 for the freezing compartment. In this process, the cool air may be supplied into the freezing compartment 12 while sequentially passing through the first auxiliary air outlet 221, the third auxiliary cool air outlet 223, and the second auxiliary cool air outlet 222 on the cool air flow path 201 for the freezing compartment.

Therefore, the freezing compartment 12 may have a sufficient pressure to prevent a phenomenon in which cool air flows back from the freezing compartment 12 to the cool air flow path 101 for the ice making compartment.

Meanwhile, when cool air heat-exchanged through the second evaporator 32 is discharged in the radial direction of the ice making fan 421 through the second inlet hole 120, there may occur a phenomenon in which the cool air flows back through the second inlet hole 120 due to the flow resistance.

However, since the second inlet hole 120 may be configured so that each of the impellers 421*c* of the ice making fan 421 is covered (or a half or more than a half thereof is covered) by the covering member 122, the cool air discharged from the ice making fan 421 may be prevented from flowing back through the second inlet hole 120, and may be blown into the cool air flow path 101 for the ice making compartment under a higher blowing pressure than cool air supplied to the cool air flow path 201 for the freezing compartment through the first inlet hole 110.

Therefore, due to the high blowing pressure, the cool air may be efficiently supplied to the ice making compartment 21 through the cool air duct 51 for the ice making compartment connected to the cool air flow path 101 for the ice making compartment.

In addition, although the cool air discharged to the third area 102*c* may flow toward the second area 102*b* located in the rotational direction of the ice making fan 421, when considering that the third area 102*c* and the second area 102*b* may be in a state of being substantially isolated from each other by the ice making fan module 420, the entire cool air discharged to the third area 102*c* may flow toward the cool air discharge side of the cool air flow path 101 for the ice making compartment under guidance of the cool air flow path 101 for the ice making compartment.

Therefore, although the supply amount of cool air to the ice making compartment 21 may be smaller than that of cool air to the freezing compartment 12, the cool air may be efficiently supplied to the ice making compartment 21 under a high blowing pressure.

The cool air supplied to the ice making compartment 21 may freeze water (or other beverages) existing in the ice tray (not illustrated) while flowing through the ice making compartment 21.

The cool air flowing through the ice making compartment 21 may flow to the recovery duct 52 for the ice making compartment, and may then be recovered into the freezing compartment 12 under guidance of the recovery duct 52 for the ice making compartment.

Then, the cool air recovered into the freezing compartment 12 may flow through the freezing compartment 12 and may then be recovered to the air introduction side of the second evaporator 32 under guidance of the suction guide 240 formed on the grill fan 200.

If the temperature in the ice making compartment 21 is lower than a predetermined temperature, the operation of the ice making fan 421 may be stopped to stop the supply of cool air to the ice making compartment 21.

Therefore, the temperature in the ice making compartment 12 may be controlled by such repetitive circulation of air (cool air).

Cool air flowing into each area of the cool air flow path 101 for the ice making compartment may flow to the other areas by rotational flow due to the operation of the ice making fan 421.

However, since the respective areas 102*a*, 102*b*, and 102*c* may be substantially isolated from each other due to the portions where the fastening ribs 422*a*, 422*b*, and 422*c* of the ice making fan module 420 are installed, the flows of cool air between the areas 102*a*, 102*b*, and 102*c* may be insignificant thus not having a great influence on each other.

As a result, in the refrigerator according to the present disclosure, the cool air flow path 201 for the freezing compartment and the cool air flow path 101 for the ice making compartment may be respectively defined by coupling of the shroud 100 and the grill fan 200, which may make it possible to simplify the overall structure of the freezing compartment-side grill fan assembly 1.

Furthermore, in the refrigerator according to the present disclosure, the first inlet hole 110 and the second inlet hole 120 may be formed in the shroud 100 and the freezing fan module 410 and the ice making fan module 420 may be installed in the respective inlet holes 110 and 120, which may make it possible to simplify the overall structure of the freezing compartment-side grill fan assembly 1.

Furthermore, in the refrigerator according to the present disclosure, the third auxiliary air outlet 223 may be formed in consideration of cool air recovered from the ice making compartment 21 to the freezing compartment 12 so that the amounts of cool air discharged from the third auxiliary air outlet 223 toward the opposite side walls of the freezing compartment 12 are different from each other, which may make it possible to achieve a uniform temperature distribution in the freezing compartment 12 and to achieve accurate temperature control for the freezing compartment 12.

Furthermore, in the refrigerator of the present disclosure, the first inlet hole 110 and the second inlet hole 120 formed in the shroud 100 may be designed in different sizes, which may make it possible to supply sufficient cool air to the freezing compartment 12 while supplying sufficient cool air even to the ice making compartment 21 located relatively farther away than the freezing compartment 12.

Furthermore, in the refrigerator according to the present disclosure, the position of the respective inlet holes 110 and 120 and the shape of the respective bell mouth 111 and 121 may be designed in a structure for applying the same type and size of the blowing fans 411 and 421, which may make it possible to commonize and standardize the blowing fans 411 and 421.

Furthermore, in the refrigerator according to the present disclosure, the shared flow path 101*d* and the supply flow path 201*e* may be formed in the cool air flow path 101 for the ice making compartment, which may make it possible to prevent the phenomenon in which cool air in the freezing compartment 12 flows back into the cool air flow path 101 for the ice making compartment when the ice making fan 421 is operated solely.

The invention claimed is:

1. A refrigerator, comprising:

a cabinet including an upper refrigerating compartment and a lower freezing compartment;

a refrigerating compartment door opening and closing the refrigerating compartment of the cabinet, and including an ice making compartment; and a freezing compartment-side grill fan assembly provided in the freezing compartment of the cabinet, and including an ice making fan module supplying cool air to the ice making compartment and a freezing fan module supplying cool air to the freezing compartment, wherein the freezing compartment-side grill fan assembly comprises a shroud having first and second inlet holes, and a grill fan coupled to a front surface of the shroud and having a main cool air outlet for allowing discharge of the cool air to the freezing compartment, wherein a cool air flow path for the freezing compartment and a cool air flow path for the ice making compartment are formed on at least one of opposed surfaces between the shroud and the grill fan, the cool air flow path for the freezing compartment guiding the cool air introduced through the first inlet hole to flow into the freezing compartment through the main cool air outlet, and the cool air flow path for the ice making compartment guiding the cool air introduced through the second inlet hole to flow into the ice making compartment, wherein the grill fan further comprises an auxiliary cool air outlet for guiding the cool air flowing along the cool air flow path for the freezing compartment to be discharged to the freezing compartment, wherein the auxiliary cool air outlet comprises a third auxiliary cool air outlet formed at a central side of a bottom surface of the cool air flow path for the freezing compartment, and wherein the third auxiliary cool air outlet is configured as a grill body with opposite sides open so that cool air is discharged toward opposite side walls of the freezing compartment.

2. The refrigerator of claim 1, wherein the freezing fan module and the ice making fan module have the same structure, and the second inlet hole is formed smaller than the first inlet hole.

3. The refrigerator of claim 2, wherein the freezing fan module comprises a blowing fan including a hub, a rim formed to surround the hub, and a plurality of impellers arranged between the hub and the rim, and the first inlet hole is formed to have a size that allows a half or more than a half of each of the impellers to be exposed.

4. The refrigerator of claim 2, wherein the ice making fan module comprises a blowing fan including a hub, a rim formed to surround the hub, and a plurality of impellers arranged between the hub and the rim, and the second inlet hole is formed to have a size that allows a half or less than a half of each of the impellers to be exposed.

5. The refrigerator of claim 4, wherein the second inlet hole is formed to have a size that allows the impeller not to be exposed.

6. The refrigerator of claim 1, wherein the first inlet hole is formed in an upper central portion of the shroud, and the second inlet hole is formed beside the first inlet hole.

7. The refrigerator of claim 1, wherein the cool air flow path for the ice making compartment is defined by a flow path rib protruding from the front surface of the shroud and guides the cool air introduced through the second inlet hole to a side of the shroud.

8. The refrigerator of claim 7, wherein the flow path rib comprises:

a first circumferential flow path rib surrounding an upper circumference of the ice making fan module; and a second circumferential flow path rib surrounding a lower circumference of the ice making fan module.

9. The refrigerator of claim 8, wherein the first and second circumferential flow path ribs are arranged spaced apart from each other, and a part of cool air blown by operation of the ice making fan module is supplied to the cool air flow path for the freezing compartment through a space between the first and second circumferential flow path ribs.

10. The refrigerator of claim 9, wherein the main cool air outlet formed in the grill fan is formed at a position above where a center of the freezing fan module is located.

11. The refrigerator of claim 10, wherein the main cool air outlet is formed to extend across where an upper end of the freezing fan module is located.

12. The refrigerator of claim 10, wherein the space between the first and second circumferential flow path ribs is formed in a direction toward an end of the main cool air outlet.

13. The refrigerator of claim 1, wherein the auxiliary cool air outlet further comprises:

a first auxiliary cool air outlet formed at a first side of the third auxiliary cool air outlet; and a second auxiliary cool air outlet formed at a second side of the third auxiliary cool air outlet.

14. The refrigerator of claim 13, wherein the shroud comprises:

a first guide formed on a first surface thereof, and guiding cool air introduced between the grill fan and the shroud through the first inlet hole to flow to the first auxiliary cool air outlet;

a second guide formed on the first surface thereof, and guiding the cool air introduced between the grill fan and the shroud through the first inlet hole to flow to the second auxiliary cool air outlet; and a third guide formed on the first surface thereof, and guiding the cool air introduced between the grill fan and the shroud through the first inlet hole to flow to the third auxiliary cool air outlet.

15. The refrigerator of claim 14, wherein the grill fan comprises a receiving guide formed on a rear surface thereof and having a receiving groove for allowing one of the first guide, the second guide, or the third guide to be received therein.

16. The refrigerator of claim 1, wherein a front surface of the third auxiliary cool air outlet is formed to be inclined toward the opposite sides thereof so as to protrude forward with respect to a predetermined reference portion thereof.

17. The refrigerator of claim 16, wherein the predetermined reference portion of the front surface of the third auxiliary cool air outlet is located biased closer to one of the opposite side walls of the freezing compartment than a remaining one of the opposite side walls.

18. The refrigerator of claim 1, wherein a recovery duct for the ice making compartment for guiding a flow of cool air recovered from the ice making compartment is installed in a side wall of the freezing compartment to communicate with the freezing compartment.

* * * * *